US007151900B2

(12) United States Patent
Utsunomiya

(10) Patent No.: US 7,151,900 B2
(45) Date of Patent: Dec. 19, 2006

(54) IMAGE FORMATION DEVICE, IMAGE FORMATION METHOD, INFORMATION PROCESSING DEVICE, AND INFORMATION PROCESSING METHOD

(75) Inventor: Takeshi Utsunomiya, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 219 days.

(21) Appl. No.: 10/990,264

(22) Filed: Nov. 16, 2004

(65) Prior Publication Data

US 2005/0105923 A1 May 19, 2005

(30) Foreign Application Priority Data

Nov. 18, 2003 (JP) ..... 2003-388377

(51) Int. Cl.
*G03G 15/00* (2006.01)

(52) U.S. Cl. ..... 399/21; 399/18; 358/1.14

(58) Field of Classification Search ..... 399/16, 399/17, 18, 19, 20, 21, 388; 358/1.14
See application file for complete search history.

(56) References Cited

U.S. PATENT DOCUMENTS 5,446,522 A * 8/1995 Tahara et al. ..... 399/8
5,913,090 A * 6/1999 Sawada et al. ..... 399/8
6,449,440 B1 * 9/2002 Sawada ..... 399/19
6,643,492 B1 * 11/2003 Kuga ..... 399/402
6,959,155 B1 * 10/2005 Kim ..... 399/21

FOREIGN PATENT DOCUMENTS

JP 62-103174 5/1987
JP 06-075985 A 3/1994
JP 08315214 A * 11/1996
JP 10187397 A * 7/1998

* cited by examiner

*Primary Examiner*—Ren Yan
(74) *Attorney, Agent, or Firm*—Canon U.S.A. Inc. I.P. Div

(57) ABSTRACT

An image forming device and control method thereof. The image forming device includes a printer engine control unit capable of detecting failure in transport of a sheet on which image data of a page is to be printed, a printer controller controlling output of image data from an output unit to a printer engine according to a first control mode wherein the image data of the page is re-outputted, and a second control mode wherein the image data of the page is not re-outputted, based upon settings in a job management table corresponding to the sheet. This enables suitable determination regarding whether or not the image data of the page corresponding to the jammed sheet should be re-outputted.

16 Claims, 16 Drawing Sheets

IMAGE FORMATION DEVICE, IMAGE FORMATION METHOD, INFORMATION PROCESSING DEVICE, AND INFORMATION PROCESSING METHOD

BACKGROUND OF THE INVENTION

1. Field of the Invention

The present invention relates to an image formation apparatus, image formation method, an information processing device, and an information processing method.

2. Description of the Related Art

In recent years, a function for detecting jamming (failure in transport of a sheet) within a printer, and a recovery function for printing an image which was to be printed on a sheet which became jammed, on another sheet, are becoming commonplace. Furthermore, it has been commonplace that the user creates important documents having confidential information such as an account or the like on a PC, and the printer prints the important documents according to instructions from the PC. Furthermore, an arrangement is known as disclosed in Japanese Examined patent application publication No. 06-75985, wherein a printer includes a switch for setting the aforementioned recovery function to ON or OFF.

In the event that jamming has occurred in printing (failure in transport of a sheet), in some cases, a part of the intended image is printed on a jammed sheet, depending upon the position where jamming has occurred within the printer. In this case, double printing is performed, i.e., the same image is printed on the jammed sheet and another sheet as a result of executing the recovery function. In a case wherein the printed image contains no confidential information, this leads to no problem. However, in some companies and institutions, in the event that double printing has been performed for important documents containing confidential information such as an account, certain procedures must be taken even if the results have been obtained by executing the recovery function. With the printer disclosed in Japanese Examined patent application publication No. 06-75985, the user must walk to the printer and operate a switch provided thereon for setting whether or not the recovery function is to be executed. The printer has been set to perform the recovery function or not to perform the recovery function based on the settings of the ON/OFF switch regardless of the content of each print job.

SUMMARY OF THE INVENTION

The present invention is directed to an improved imaging formation device and an image formation method.

The imaging formation device has a function that in the event that failure in transport of a sheet occurs for a certain page of an image formation job for printing image data formed of multiple pages, the device makes suitable determination on whether or not the image data of the certain page should be printed on another sheet based upon the information with regard to the image formation job.

An image formation device according to a first aspect of the present invention includes: a generating unit configured to generate an image formation job in order to form image data of multiple pages; an image formation unit configured to form an image on a sheet based upon the image data; a transport unit configured to transport the sheet; an output unit configured to output the image data generate by the generating unit to the image formation unit so as to form an image on a paper sheet; a detecting unit configured to detect transport failure of paper sheet by the transport unit; a setting unit allowing setting, to the image formation job, a sheet jamming mode to a first mode in which the output unit re-outputs the image data to the image formation unit subsequent to the detecting unit detecting the transport failure of the sheet, and to a second mode in which the output unit does not re-output the image data to the image formation unit subsequent to the detecting unit detecting the transport failure of the sheet; a determining unit configured to determine the sheet whether or not the image data of the page should be output again by the output unit based upon information regarding the image formation job generated by the generating unit; and a control unit controlling the output unit according to the sheet jamming mode determined by the determining unit.

An image formation device according to a second aspect of the present invention includes: a generating unit configured to generate an image formation job including image data of multiple pages; an image formation unit configured to form an image on a sheet based upon the image data; a transmitting unit configured to output the image formation job to the image formation unit; and an adding unit configured to add a first information and a second information to the image formation job, wherein the first information specifies whether or not image data of a first page of the plurality of pages should be re-outputted from the transmitting unit due to a sheet transport failure, and the second information specifies whether image data of a page subsequent to the first page should be outputted responsive to the image data of the first page not being re-outputted, and wherein the transmitting unit outputs the image formation job, including the first and second information, to the image formation unit.

An image formation method according to a third aspect of the present invention includes: a generating step of generating an image formation job including image data of multiple pages; an output step for outputting the image data corresponding to the image formation job; an image formation step of forming an image on a sheet based upon the image data outputted in the output step; a detecting step of detecting whether or not a transport failure of the sheet on which the image of a page is to be printed has occurred; a determining step of determining whether or not the image data of the page should be re-outputted in the output step based upon the image formation job generated in the generating step; a re-outputting step of re-outputting the image data of the page responsive to detecting the transport failure in the detecting step and to determining that the image data of the page should be re-outputted; and a setting step of setting, to the image formation job, whether or not to output image data of a page subsequent to the page that failed to transport.

An information processing method according to fourth aspect of the present invention includes: a generating step of generating an image formation job in order to form image data of multiple pages; an adding step of adding first information and second information to the image formation job responsive to a transport failure of a sheet of a page corresponding to the image formation job, wherein the first information specifies whether or not the image data of the page should be outputted again to an image formation device, and the second information specifies whether or not image data of a page subsequent to the page corresponding to the failed transport should be outputted in a case where the image data of the page corresponding to said failed transport is not re-outputted; and a transmitting step of transmitting the image formation job, including the information added in the adding step, to the image formation device.

Other features and advantages of the present invention will be apparent from the following description taken in conjunction with the accompanying drawings, in which like reference numerals designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DESCRIPTION OF THE EMBODIMENTS

First Embodiment

Figure 1:
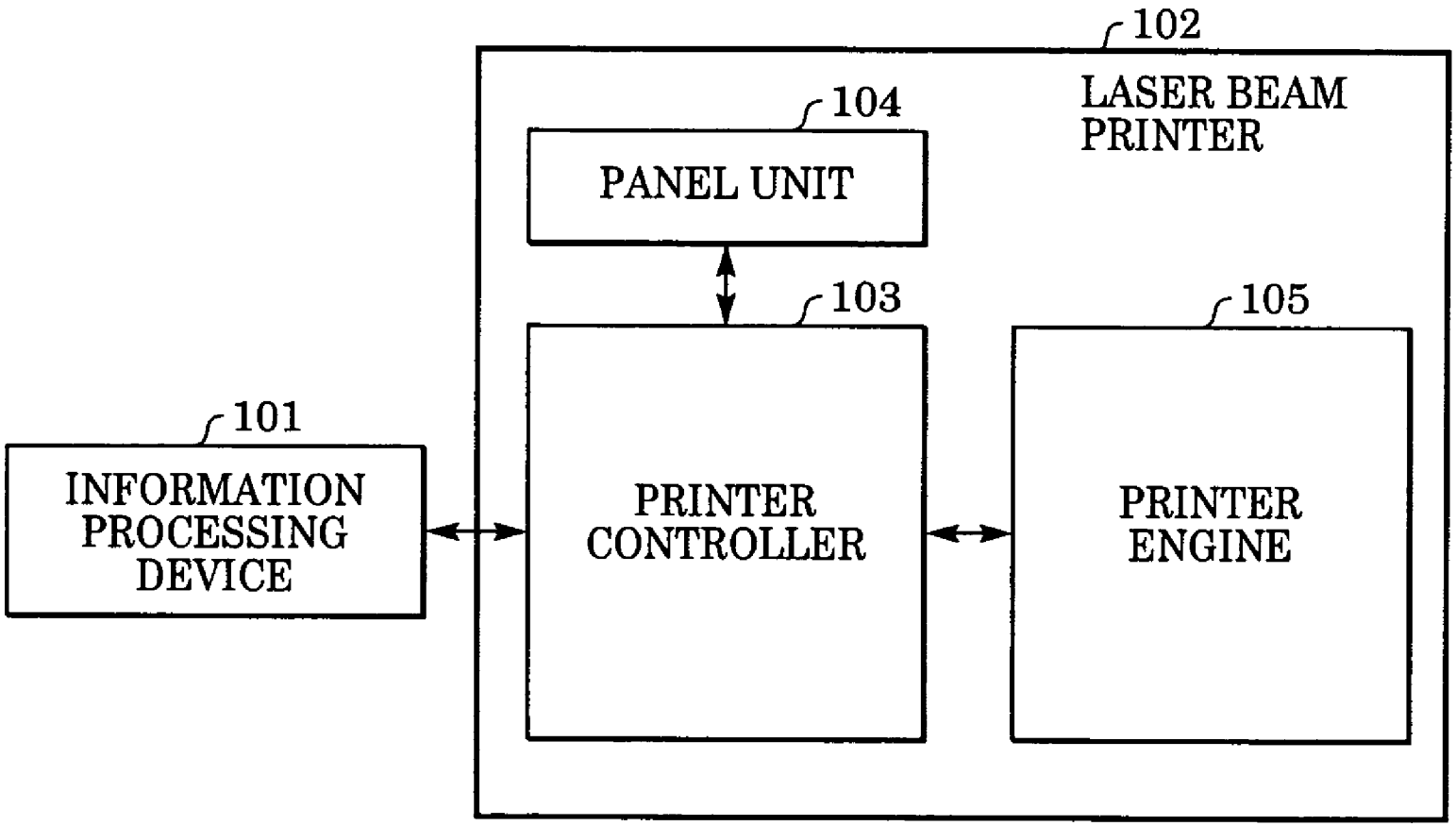
FIG. 1 is a schematic diagram which shows a system configuration of a printer according to an embodiment of the present invention.

Detailed description will be made below regarding an embodiment according to the present invention, with reference to the drawings. FIG. 1 is a schematic diagram which shows a system configuration of a printer according to an embodiment of the present invention. In FIG. 1, an information processing device 101 includes a host computer, for example, and has functions as a supply source of image information, or serving as a control device for controlling a printer. Note that with the present embodiment, a laser beam printer (printer) is employed as a printer 102.

The printer 102 includes a printer controller 103, a panel unit 104 and a printer engine 105. The printer controller 103 creates raster data for each page based upon the image information (e.g., image data, page description language, or the like) supplied from the information processing device 101, and outputs the raster data to the printer engine 105. The printer engine 105 forms a latent image on a photosensitive drum based upon the raster data supplied from the printer controller 103. Then, the latent image is transferred onto a recording medium, and is fixed to the recording medium (electrophotography), whereby the image is recorded. The panel unit 104 functions as a user interface. The user can control desired operations by operating the panel unit 104.

Figure 2:
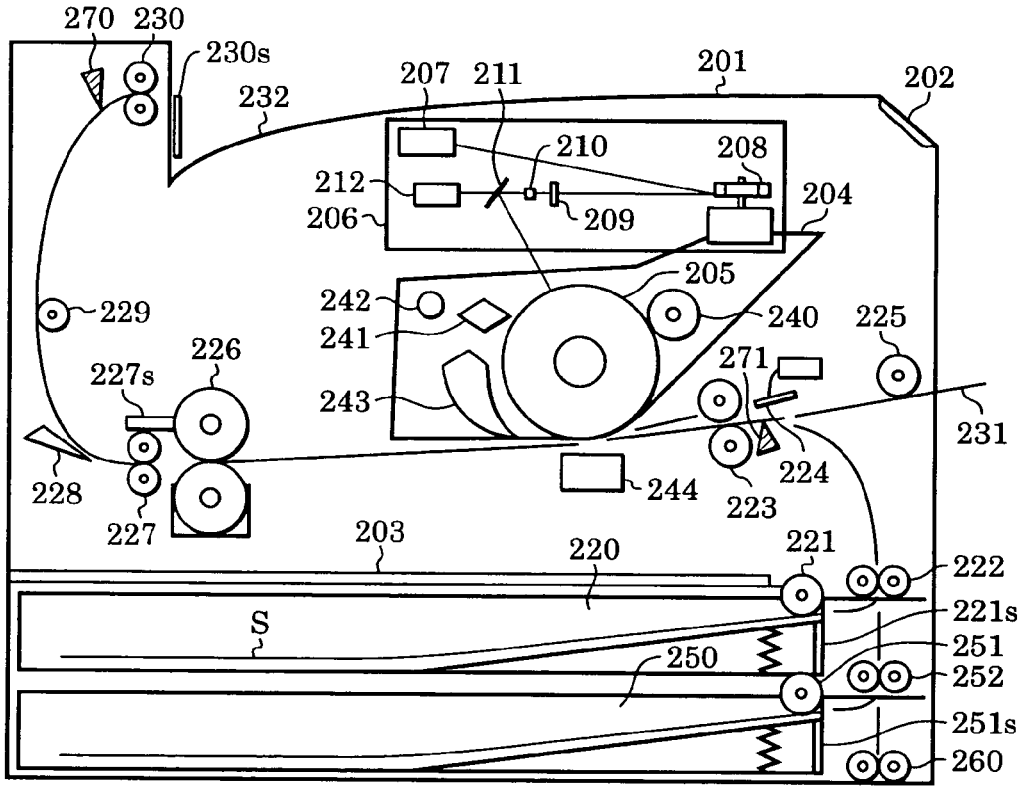
FIG. 2 is a cross-sectional view of the configuration of the printer.

FIG. 2 is a cross-sectional diagram which shows the configuration of a printer 102. In FIG. 2, reference numeral 201 denotes a printer casing. Reference numeral 202 denotes an operation panel including switches which allows the user to input various instructions, and LED indicators or LCD indicators for displaying a message, current settings of the printer, and so forth. Note that the operation panel 202 serves as an example of the panel unit 104 shown in FIG. 1.

Reference numeral 203 denotes a container for storing a board. Specifically, the container 203 stores an electric circuit board including the printer controller 103 and the printer engine 105. Reference numeral 220 and 250 denote sheet cassettes configured to hold paper sheets (recording media) S, and has a mechanism for electrically detecting the sheet size with an unshown partition. Reference numerals 221 and 251 denote cassette clutches. Each of the cassette clutches 221 and 251 includes a cam for picking up the topmost sheet S in the sheet cassettes 220 and 250, respectively, and transporting the sheet S thus picked up to feeding rollers 222 and 252, respectively, by transporting force transmitted from unshown driving means. The aforementioned cam is intermittently rotated for each feeding. That is to say, a single sheet S is fed for each rotation of the cam. Reference numerals 221*s* and 251*s* denote sheet detection sensors, each of which has a function for detecting the number of the sheets S held by the respective sheet cassettes 220 and 250.

The feeding roller 222 has a function for transporting the front end of the sheet S to a resist shutter 224. On the other hand, the feeding roller 252 has a function for transporting the front end of the sheet S to the feeding roller 222. Reference numeral 260 denotes an option feeding roller (a separate roller for a hand-feed option) having a function for supplying the sheet S fed from an unshown feeding option unit to the main unit of the printer 102. The resist shutter 224 has a function for stopping feeding of the sheet S by pressing the sheet S. Reference numeral 271 denotes a resist sensor, and has a function for detecting the presence or absence of the sheet S transported toward the resist shutter 224 by the action of the feeding roller 222. In a case wherein the resist sensor 271 has detected the presence of the sheet S at the detection position of the resist sensor 271 shown in FIG. 2, the resist sensor 271 outputs signals to a printer engine control unit 1300 (described below) for notifying the system of the presence of the sheet S. On the other hand, in a case wherein the resist sensor 271 has detected the absence of the sheet S, the resist sensor 271 outputs signals to the aforementioned printer engine control unit 1300 for notifying the system of the absence of the sheet S.

Reference numeral 231 denotes a manual feed tray, and reference numeral 225 denotes a manual feed clutch. The manual feed clutch 225 has a function for transporting the front end of the sheet S up to the resist shutter 224. The user selects one of the feeding means from the sheet cassettes 220 and 250, and the manual feed tray 225, for feeding the sheet S which is to be used for recording an image.

The printer engine 105 communicates with the printer controller 103 according to a predetermined communication protocol, selects the feeding means from the sheet cassettes 220, 250, and the manual feed tray 225, according to instructions from the printer controller 103, and transports the sheet S from the selected feeding means up to the resist shutter 224 according to instructions for starting of printing processing. Note that the printer engine 105 includes: feeding means; a mechanism for performing electrophotography processing such as formation of a latent image, transferring, fixing, and so forth; discharging means; and control means thereof.

Reference numeral 204 denotes an image recording unit including a photosensitive drum 205, a toner holder, and the like, which has a function for forming a toner image on the sheet S through electrophotography processing. On the other hand, reference numeral 206 denotes a laser scanner unit having a function for supplying image information to the image recording unit 204 by casting a laser beam thereon.

The laser scanner unit 206 includes a laser unit 207 for driving a built-in semiconductor laser so as to cast a laser beam according to image signals (VIDEO signals) transmitted from the printer controller 103. The laser beam cast from the laser unit 207 is scanned with a polygon mirror (rotating polygonal mirror) 208 so as to form a latent image on the photosensitive drum 205 through a focusing lens set 209 and a reflection mirror 211. Reference numeral 210 denotes a beam detector for detecting the laser beam cast from the laser unit 207, and outputting main-scanning synchronization signals. Reference numeral 212 denotes a light-quantity sensor for detecting the quantity of light cast from the laser unit 207.

The image recording unit 204 includes a primary charger 241 for uniformly charging the photosensitive drum 205. Reference numeral 240 denotes a developing device for developing a latent image with toner, which has been formed on the photosensitive drum 205 by the laser scanner unit 206 casting a laser beam onto the photosensitive drum 205 charged by the primary charger 241. Reference numeral 244 denotes a transfer charger for transferring the toner image on the photosensitive drum developed by the developing device 240 to the sheet S supplied from a resist roller 223. Reference numeral 243 denotes a cleaner for removing toner remaining on the photosensitive drum 205. Reference numeral 242 denotes a pre-exposure lamp for removing static electricity on the photosensitive drum 205 using light. Reference numeral 226 denotes a fixing device for performing thermal fixing of the toner image on the sheet S formed by the image recording unit 204. Reference numeral 227 denotes a transporting roller for discharging and transporting the sheet S. Reference numeral 227s denotes a sheet-discharge sensor for detecting whether or not the sheet S has been discharged. Reference numeral 228 denotes a discharge flapper for switching the transporting direction of the sheet S on which image recording has been made, to the direction toward a facedown discharge tray 232, the direction toward an unshown faceup discharge tray, or the direction toward to an unshown discharge option unit. Reference numerals 229 and 230 denote discharge rollers for discharging the sheet S to the facedown discharge tray 232, which has been transported through switching made by the discharge flapper 228. Reference numeral 270 denotes a sheet-discharge sensor for detecting the presence or absence of the sheet S which has been discharged to the discharge tray 232 by the discharge roller 230. In a case wherein the sheet-discharge sensor 270 has detected the presence of the sheet S at the detection position of the resist sensor 270 shown in FIG. 2, the resist sensor 270 outputs signals to the printer engine control unit 1300 for notifying the system of the presence of the sheet S. On the other hand, in a case wherein the resist sensor 270 has detected the absence of the sheet S, the resist sensor 270 outputs signals to the aforementioned printer engine control unit 1300 for notifying the system of the absence of the sheet S. Reference numeral 230s denotes a discharged-sheet stacked-amount detection sensor for detecting the amount of sheets S stacked on the facedown discharge tray 232. The printer 102 may further include option units such as an option cassette, an envelope feeder, and so forth.

Figure 13:
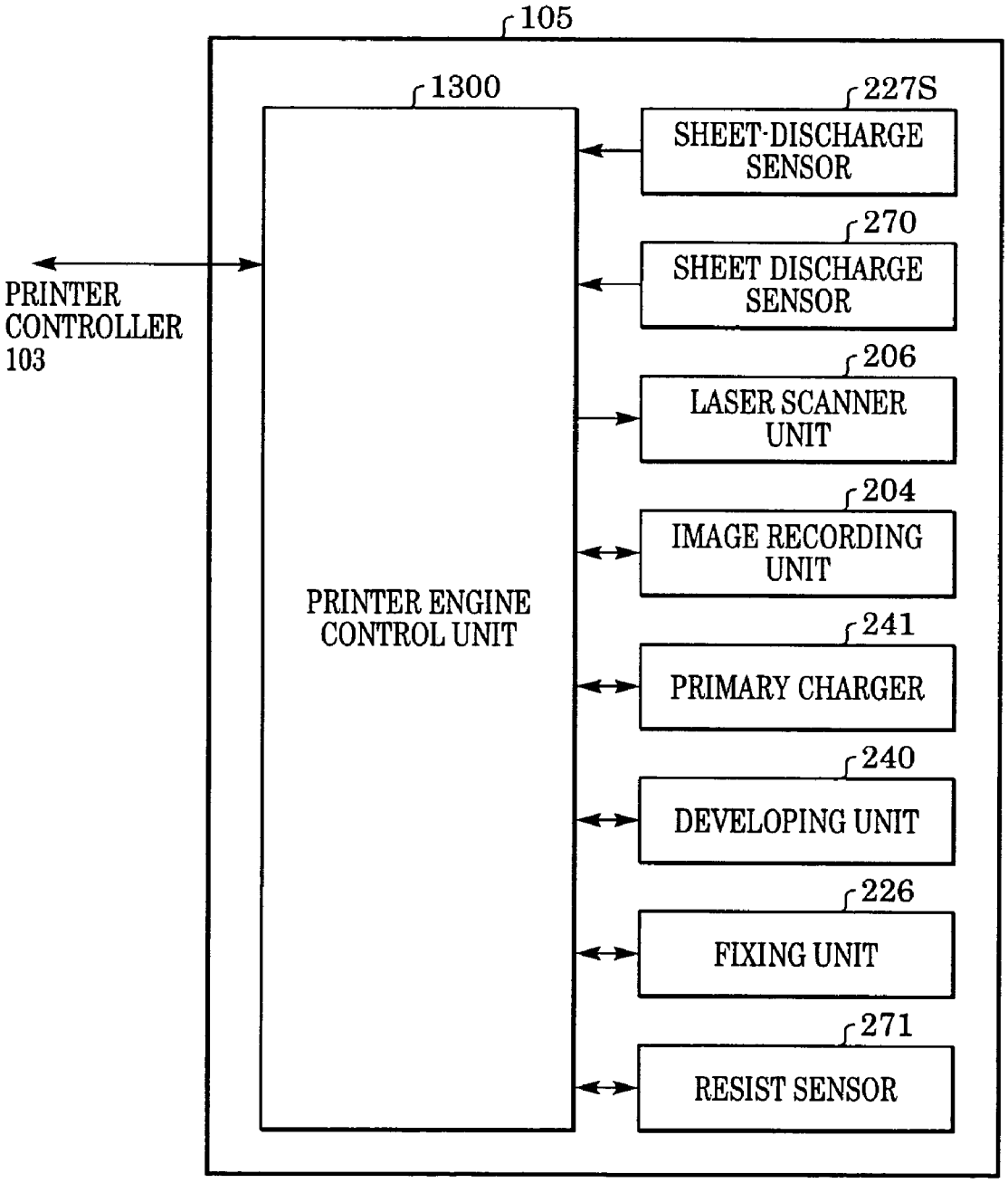
FIG. 13 is a block diagram which shows a control mechanism of a printer engine.

Now, description will be made regarding the control mechanism of the printer engine 105 with reference to FIG. 13. The printer engine 105 includes the printer engine control unit 1300 for controlling the printer engine 105 according to the command transmitted from the printer controller 103. The printer engine control unit 1300 monitors the signals regarding the presence or absence of the sheet S output from the sheet-discharge sensor 227S, the sheet-discharge sensor 270, and the resist sensor 271, thereby detecting whether or not failure in transport of the sheet S has occurred within the printer 102. Furthermore, the printer engine control unit 1300 controls the laser scanner unit 206, the image recording unit 204, the primary charger 241, the developing device 240, and the fixing device 226.

Figure 3:
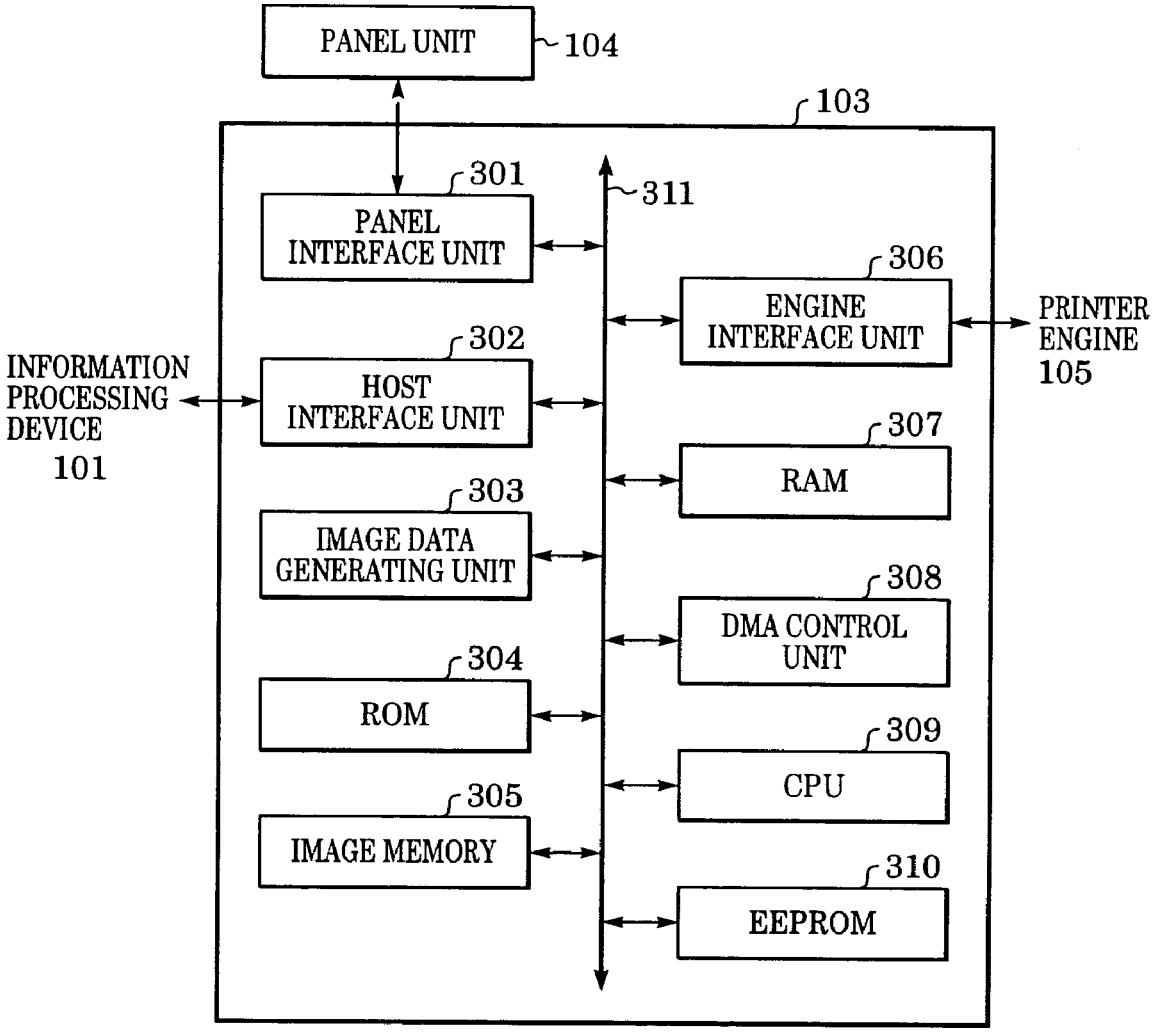
FIG. 3 is a block diagram which shows a configuration example of a printer controller.

FIG. 3 is a block diagram which shows a configuration example of the printer controller 103. Here, reference numeral 301 denotes a panel interface unit for performing data communication with the panel unit 104. A CPU 309 checks the settings and instructions input by the user via the panel unit 104 through the panel interface unit 301. Reference numeral 302 denotes a host interface unit for connecting the printer controller 103 to the information processing device 101, such as a host computer or the like, via a network, which allows parallel communication therebetween. Reference numeral 306 denotes an engine interface unit for connecting the printer controller 103 to the printer engine 105, which allows parallel communication therebetween. The CPU 309 controls signals through the engine interface unit 306, and checks the signal state, i.e., the state of the printer engine 105.

Reference numeral 303 denotes an image data generating unit for generating raster data based upon the image information supplied from the information processing device 101. The raster data thus generated is supplied to the printer engine 105. Reference numeral 305 denotes image memory for temporarily storing the raster data thus generated, reference numeral 309 denotes the CPU for controlling devices connected to a CPU bus 311, according to the control program code stored in ROM 304, reference numeral 307 denotes RAM serving as temporary storage memory used by the CPU 309, and reference numeral 310 denotes EEPROM comprising nonvolatile memory, for example, for storing the control information such as density correction table and so forth. Reference numeral 308 denotes a DMA control unit for transmitting the raster data stored within the image memory 305 to the engine interface unit 306 according to instructions from the CPU 309.

Reference numeral 311 denotes the CPU bus including an address bus, a data bus, and a control bus. The CPU bus 311 allows the system access to all the devices connected to the CPU bus 311, such as the panel interface unit 301, the host interface unit 302, the image data generating unit 303, the ROM 304, the image memory 305, the engine interface unit 306, the RAM 307, the DMA control unit 308, the CPU 309, and the EEPROM 310.

Figure 4:
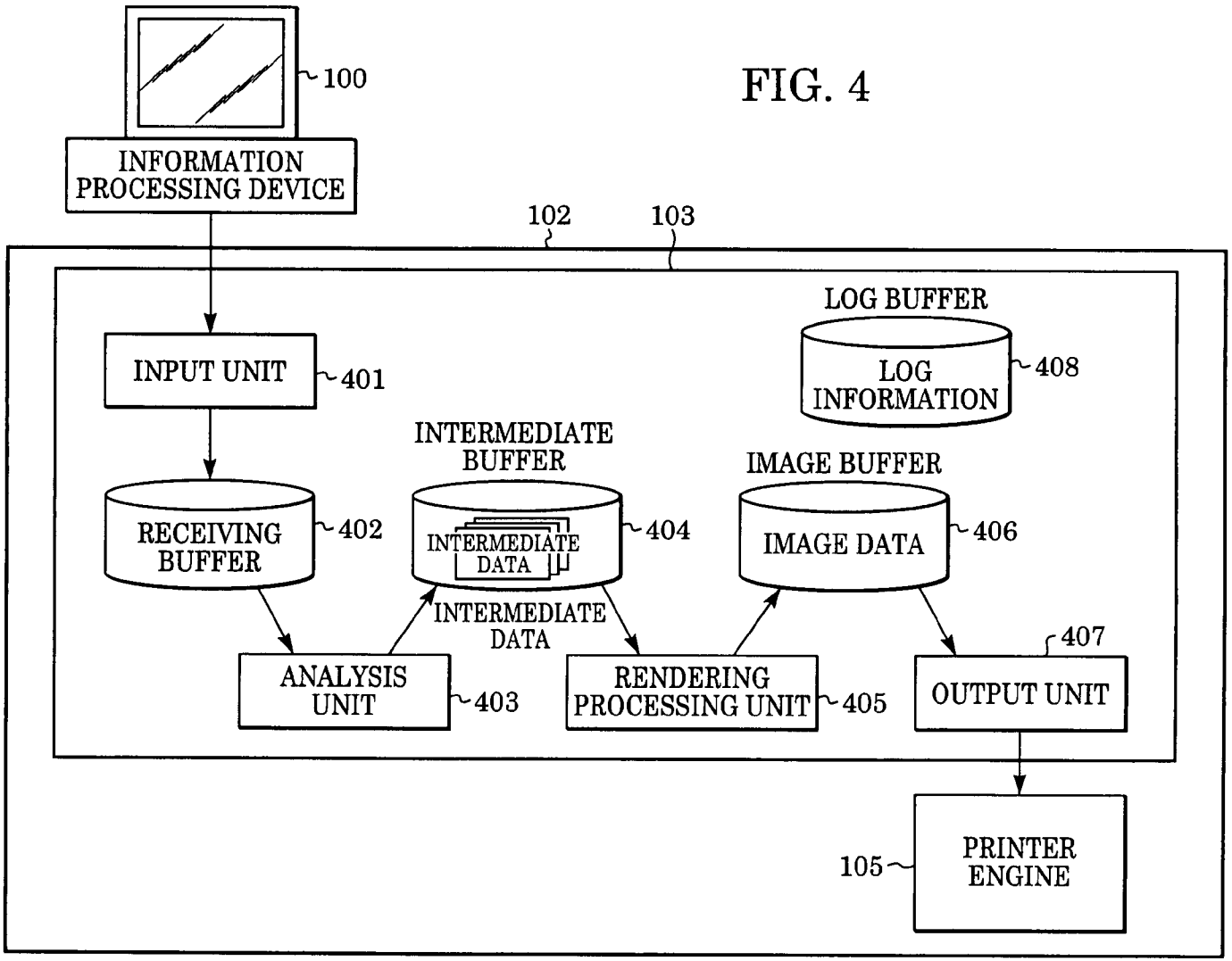
FIG. 4 is a block diagram showing the data flow through the components of the printer according to the present embodiment.

FIG. 4 is a block diagram showing data flow through the components of the printer 102 according to the present embodiment.

The information processing device 101 is connected to the main unit of the printer 102 through an interface cable. An input unit 401 is included for facilitating communication between the printer 102 and the information processing device 101. The input unit 401 has functions for analyzing the communication protocol, and storing the data input from the information processing device 101 in a receiving buffer 402. Upon the receiving buffer 402 storing the data, an analysis unit 403 starts operation. Specifically, the analysis unit 403 reads out the data stored in the receiving buffer 402, analyzes the data so as to generate object data (intermediate data), and stores the generated object data in an intermediate buffer 404. That is to say, the analysis unit 403 analyzes packet data (including image data regarding multiple pages) having a data structure shown in FIG. 5 described below, and generates a (image formation) job including image data regarding multiple pages. While description will be made regarding an arrangement wherein the printer employs a PDL (Page Description Language) as a printing command language, the printing command language supported by the printer according to the present invention is not restricted to the PDL, but can be any printing command language as long as the image data can be printed for each page. The intermediate data is managed for each page. Upon the intermediate buffer 404 storing the data, a rendering processing unit 405 starts operation.

The rendering processing unit 405 reads out the intermediate data from the intermediate buffer 404 for each page, generates printing image data for each page, and stores the printing image data in an image buffer 406. Upon the rendering processing unit 405 generating the image data for one page, an output unit 407 starts operation. Specifically, the output unit 407 reads out the image data from the image buffer 406, converts the image data into video signals, and transmits the video signals to the printer engine 105. Upon transmission of the video signals to the printer engine 105, actual printing is performed. Note that a log buffer 408 is used as a region for storing the history (log data) of the job programs.

The job history records a job-receiving point in time, a job-end point in time, number of printed sheets, job name, user name, information on whether or not the job has ended correctly, and so forth, in the same way as with the job-reception history of a facsimile. The user can print the information stored in the log buffer 408 through a menu operation. Furthermore, the information processing device 101 can receive the information stored in the log buffer 408 using the FTP protocol or the like.

Figure 5:
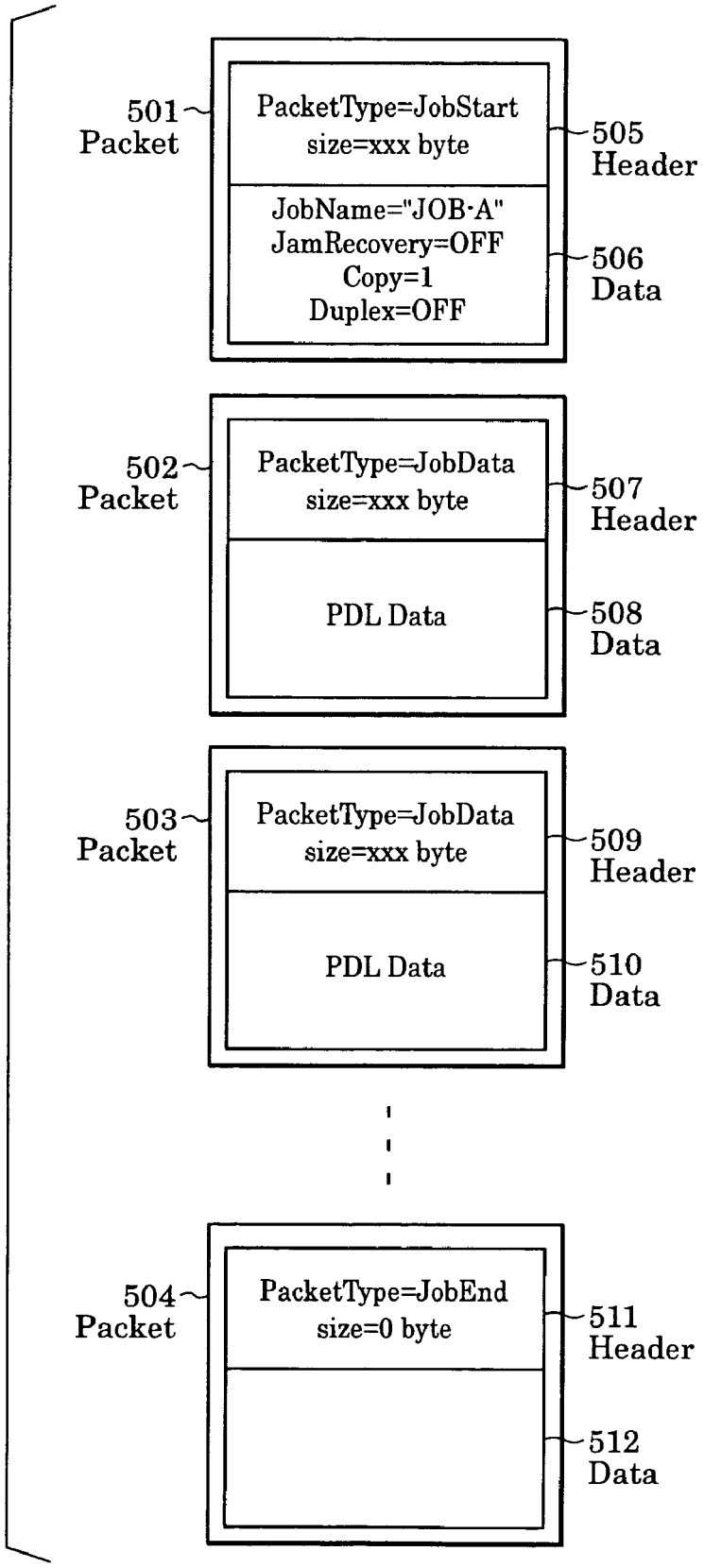
FIG. 5 is a diagram which shows a data format employed for inputting data from an image processing device to the printer.

FIG. 5 is a diagram which shows a data format sent from the information processing unit 101 to the printer 102.

The data has a packet structure. The packet structure is formed of a header portion and a data portion. The header portion stores the type of packet data, and the size of the data portion. Let us say that the size of the header portion is fixed. FIG. 5 shows data for one job. A job includes a job-start packet 501 which starts the job, and a job-end packet 504 which completes the job. Note that the printer 102 recognizes the packets from the job-start packet 501 up to the job-end packet 504 as a single job. In actual data structure, the single job includes multiple data packets between the job-start packet 501 and the job-end packet 504. The data packet stores the PDL data which is the actual printing data. In some cases, the printing data is divided into data sets stored in multiple packets for transport. In this case, there is no need to divide the printing data according to any particular rule. That is to say, there is no need to divide the data for each page.

The header portion 505 of the job-start packet 501 stores the type of the packet and the information regarding the size of the data portion 506. On the other hand, the data portion 506 of the job-start packet 501 stores the job properties such as the job name, the settings whether the jamming recovery function is set to ON or OFF, the number of copies, the settings whether or not double-sided printing is made, and so forth. The data packet 502 is formed of the header portion 507 and the data portion 508. The header portion 507 of the data packet 502 stores the type of the packet and the information regarding the size of the data portion 508. The data portion 508 of the data packet 502 stores the PDL data. The data packet 503 has the same data structure as the data packet 502. The job-end packet 504 is formed of the header portion 511 and the data portion 512. The header portion 511 of the job-end packet 504 stores the type of the packet and the information regarding the size of the data portion 512. Note that the size of the data portion 512 of the job-end packet 504 is zero.

Figure 6:
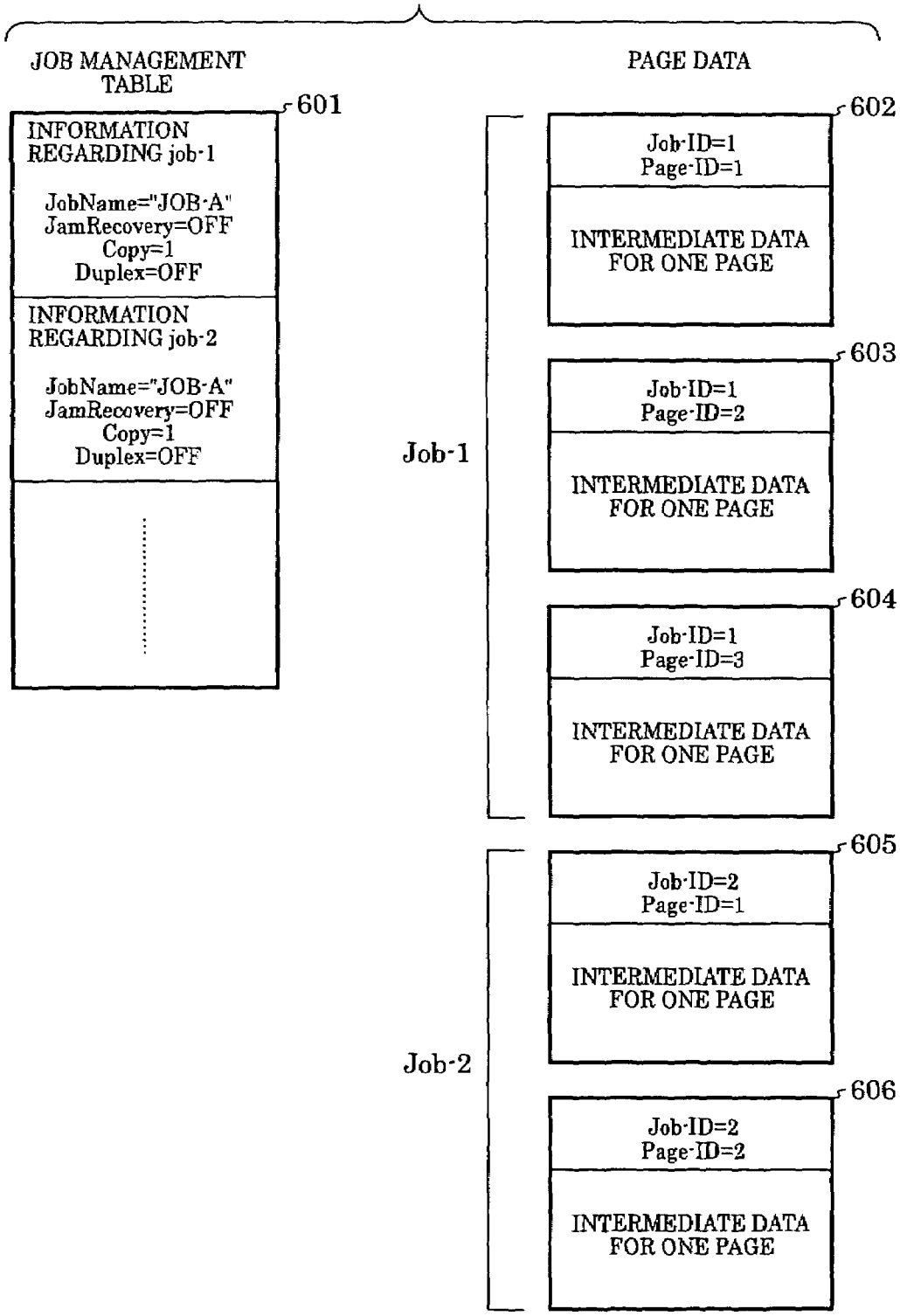
FIG. 6 is a diagram which shows a data structure of a job management table and a data structure of each page data.

FIG. 6 is a diagram which shows the data structure of a job management table and the data structure of each page data set. The job information is registered in the job management table at the time that the analysis unit 408 has analyzed the job-start packet 501. That is to say, the job properties stored in the data portion 506 of the job-start packet 501 are stored in the job management table. On the other hand, the intermediate data is managed for each page. Each page data set is formed of an information portion and an intermediate data portion. The information portion stores information regarding the job ID and the page ID of the corresponding intermediate data. FIG. 6 shows the page data sets 602 through 606. Upon completion of printing of the image data on an actual sheet, the system receives the signals from the printer engine 105, and removes the intermediate data of the corresponding page according to the received signals serving as a trigger. Note that completion of printing on a sheet means completion of a series of steps of: transferring step wherein a toner image is transferred from the photosensitive drum 205 onto the sheet S by the action of the transfer charger 244; thermal fixing step wherein thermal fixing of the toner image on the sheet S is performed by the action of the fixing device 226; and discharging step wherein the sheet S passes through the sheet-discharge sensor 270. Upon completion of removal of the intermediate data for all pages, the information regarding the corresponding job is removed from the job management table.

Figure 7A:
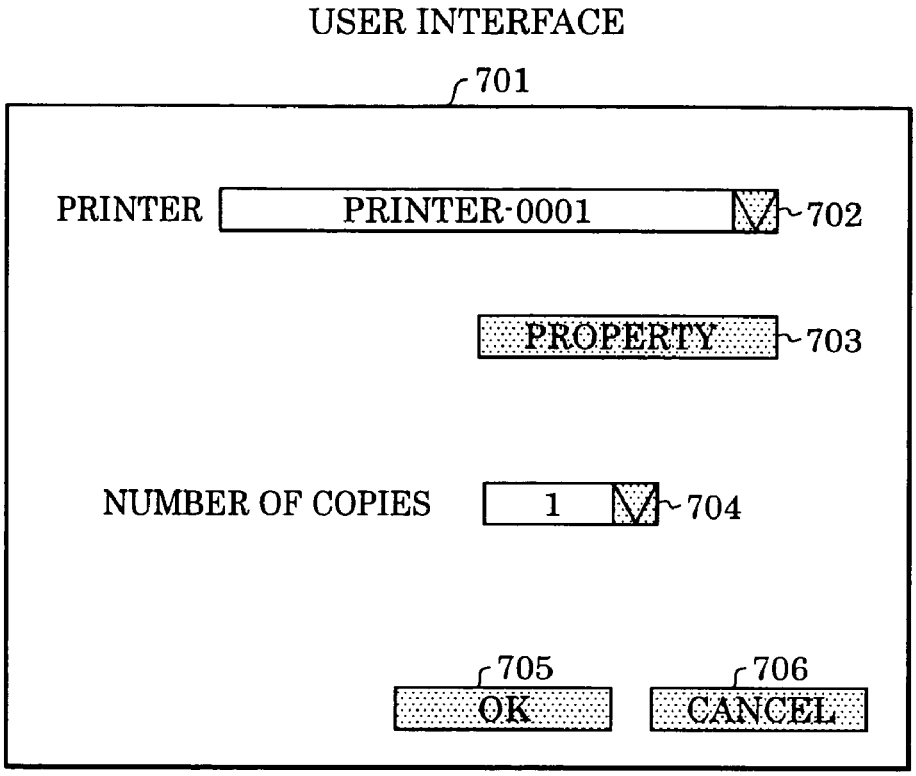
FIGS. 7A and 7B are diagrams which show a user interface displayed on a monitor of the information processing device.
Figure 7B:
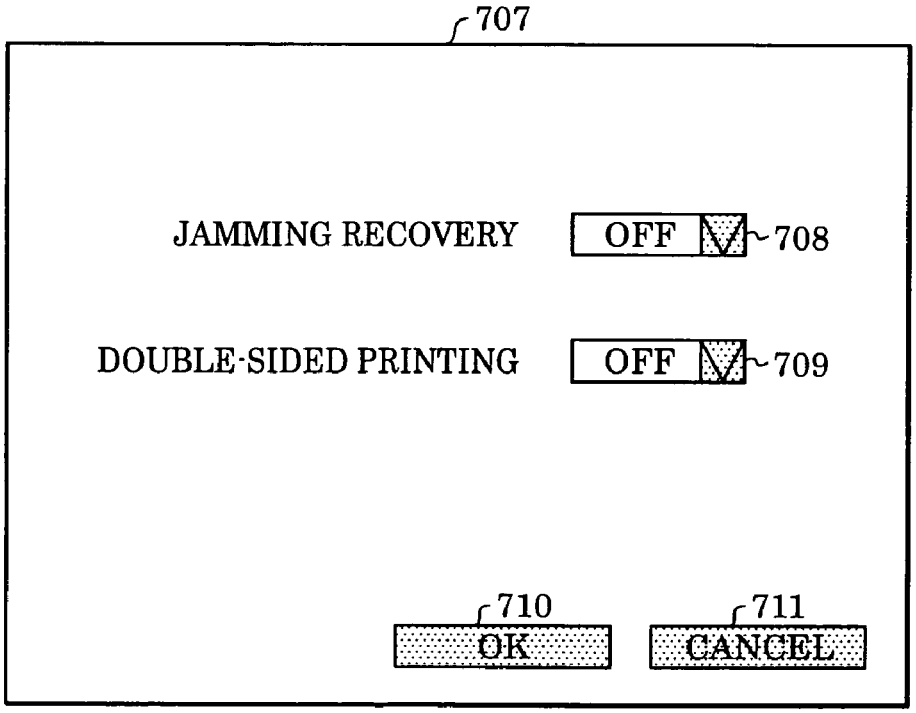
Figure 12:
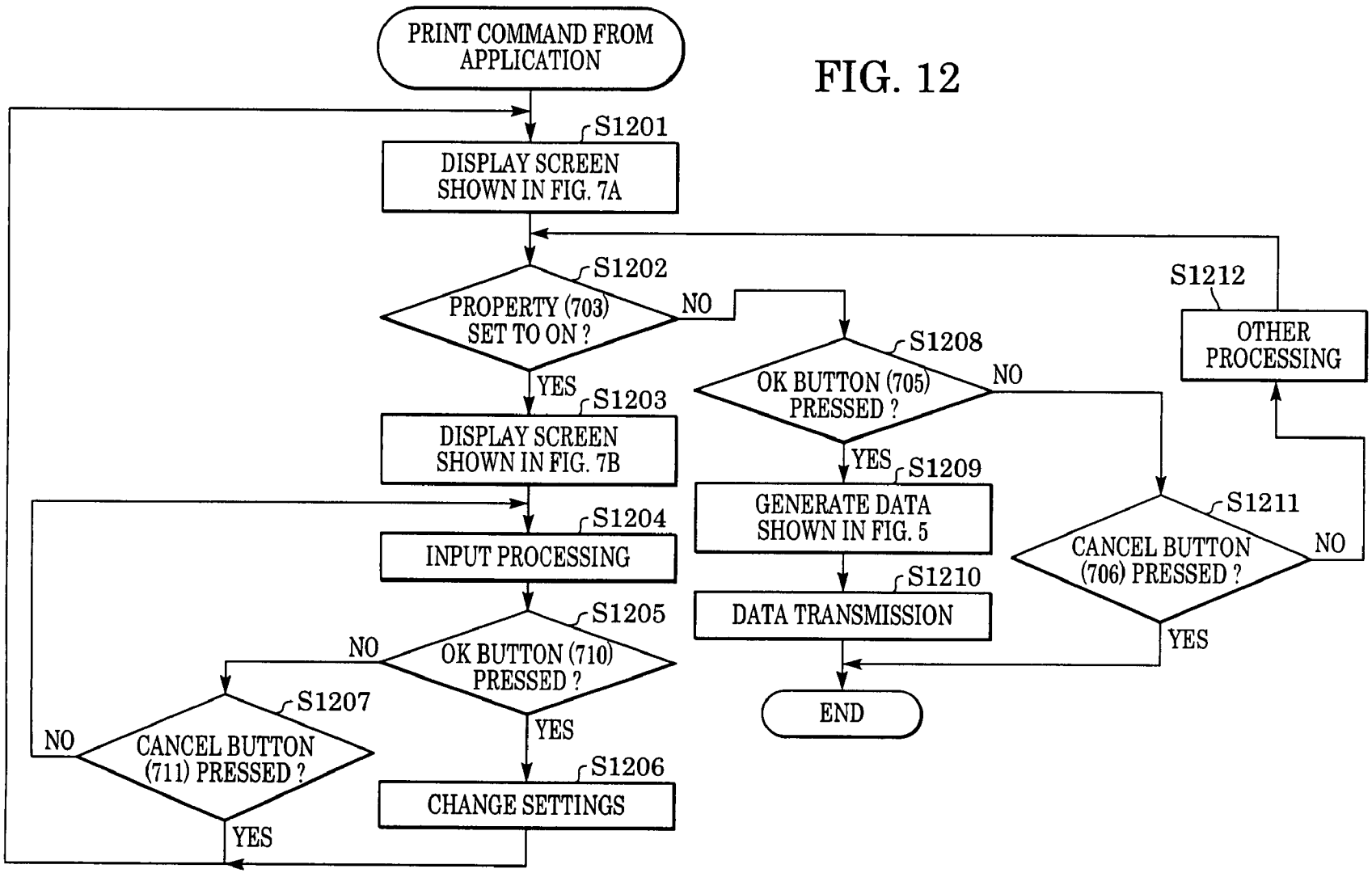
FIG. 12 is a flowchart which shows processing of a printer driver program executed by the image processing device.

Next, description will be made regarding processing executed according to a printer driver program stored in the information processing device 101 with reference to FIG. 12. FIGS. 7A and 7B are diagrams which show a user interface displayed on a monitor of the information processing device 101 according to the present embodiment.

In Step S1201, upon the user instructing the system to perform "printing" through an application program, a screen 701 is displayed as shown in FIG. 7A. Reference numeral 702 denotes an input unit which allows the user to select the printer 102. The user can select the printer 102 from printers which have been registered beforehand. Reference numeral 703 denotes a property button. In Step S1202, the system determines whether or not the user has clicked the property button 703 with a mouse. In the event that determination is made that the user has clicked the property button 703, the flow proceeds to Step S1203, displays a screen 707 as shown in FIG. 7B, which allows the user to make detailed settings. Note that the system displays a property screen corresponding to the type of printer 102.

Reference numeral 708 denotes an input portion which allows the user to specify ON/OFF of the jamming recovery function. Reference numeral 709 denotes an input portion which allows the user to specify whether or not double-sided printing is made. In Step S1204, the system performs input processing for the input portions 708 and 709. Reference numeral 710 denotes an OK button. In Step S1205, the system determines whether or not the user has clicked the OK button 710. In the event that determination is made that the OK button 710 has been clicked, the flow proceeds to Step S1206, in which the settings of the printer 102 are changed to the setting values on the property screen 707, and the screen 701 is displayed again. Reference numeral 711 denotes a cancel button. In Step S1207, the system determines whether or not the user has clicked the cancel button 711. In the event that determination is made that the cancel button 711 has been clicked, the settings of the printer 102 are not changed, and the screen 701 is displayed again.

In FIG. 7A, reference numeral 705 denotes an OK button. In Step S1208, the system determines whether or not the user has clicked the OK button 705. In the event that determination is made that the OK button 705 has been clicked, the flow proceeds to Step S1209, in which data with a data format shown in FIG. 5 is generated according to the settings thus determined. Specifically, in the event that the user has set the jamming recovery function to ON through the input portion 708, a flag "JamRecovery" stored in the data portion 506 is set to "ON." On the other hand, in the event that the user has set the jamming recovery function to OFF, the flag "JamRecovery" stored in the data portion 506 is set to "OFF." Then, the data with the data format shown in FIG. 5 generated in Step S1209 is transmitted to the printer 102 (spooler) in step S1210. Reference numeral 706 denotes a cancel button. In step S1211, the system determines whether or not the user has clicked the cancel button 706. In the event that determination is made that the cancel button 706 has been clicked, printing processing is canceled. If it is determined that the cancel button 706 has not been clicked, the flow proceeds to step S1212 where other processing is performed and then proceeds to step S1202.

Figure 8:
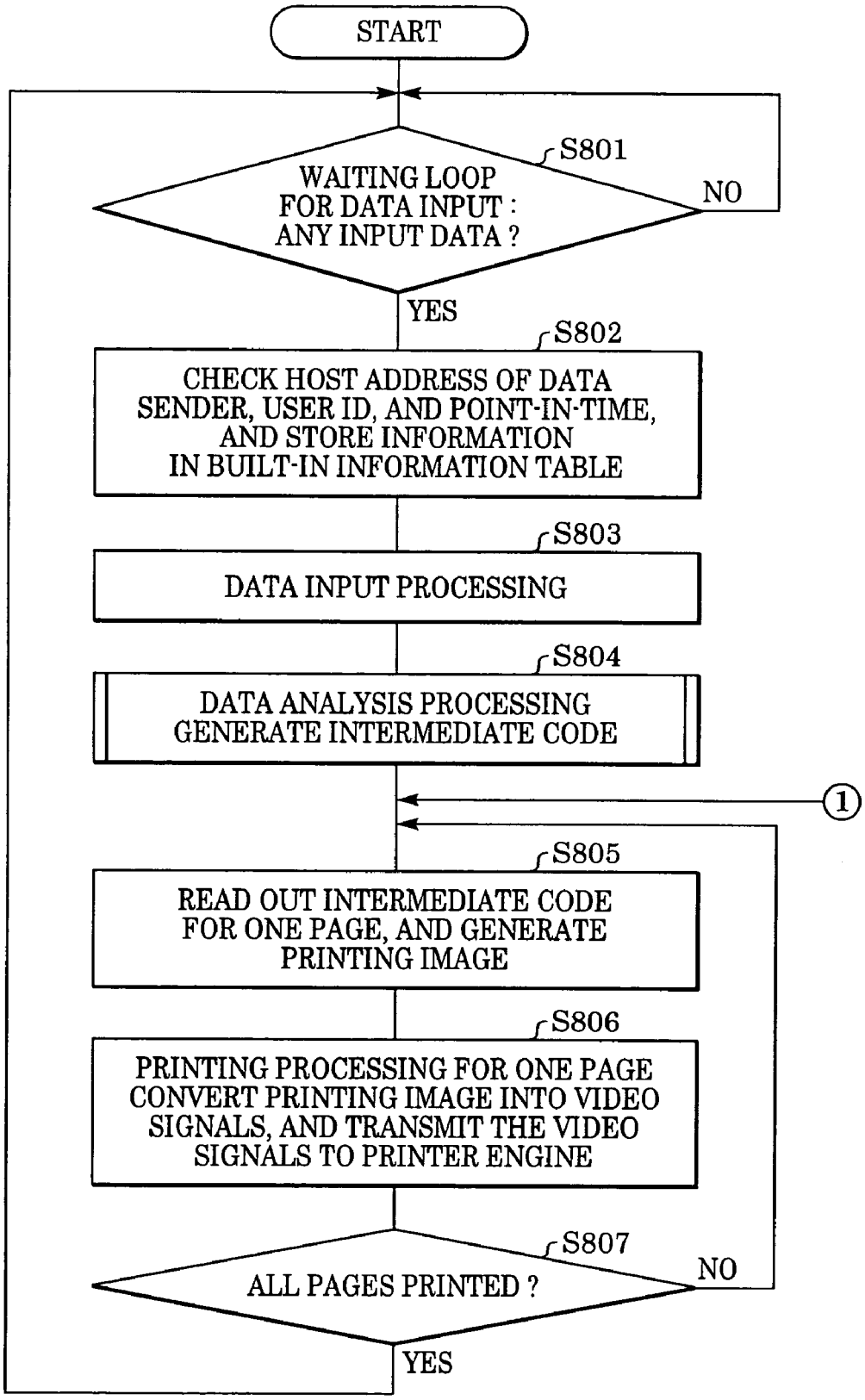
FIG. 8 is a flowchart which shows main processing performed by a printer controller.

FIG. 8 is a flowchart which shows main processing performed by the printer controller 103. Upon turning on the power supply, the system performs various kinds of unshown initial processing, following which the flow proceeds to Step S801 serving as an input standby loop. Upon the information processing device 101 inputting printing data to the printer 102 through the network, the flow exits from the input standby loop, and proceeds to Step S802. In step S802, the system extracts the network address or the hardware address of the information processing device 101 serving as a data sender, the point in time, and the user ID, from the printing data transported from the information processing device 101 and the information stored in the network protocol packet, and stores the information thus extracted.

Figure 9:
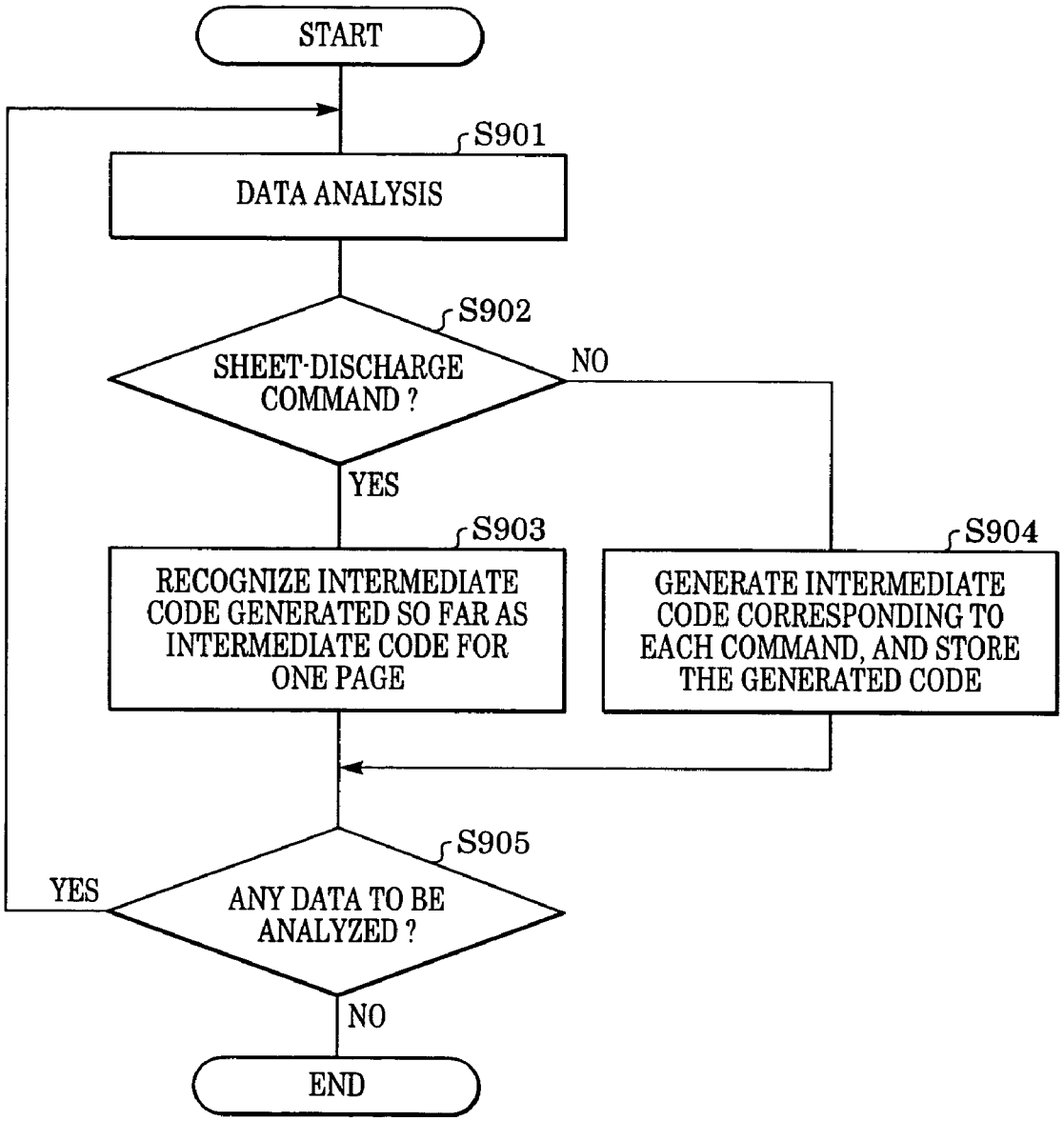
FIG. 9 is a flowchart for making detailed description regarding data analysis processing.

In Step S803, the system performs input processing for the printing data. The input data is stored in the receiving buffer 402. In Step S804, the analysis unit 403 analyzes the data stored in the receiving buffer 402. Following analysis of data, the analysis unit 403 generates the intermediate data having a format which facilitates data handling in the system according to the commands. The intermediate data is managed for each page, and is stored in the intermediate buffer 404. FIG. 9 is a diagram of the processing in Step S804.

In step S805, the rendering processing unit 405 reads out the intermediate data for one page from the intermediate buffer 404, and generates a printing image (bit map) based upon the intermediate data. The printing image thus generated is temporarily stored in the image buffer 406. In Step S806, the output unit 407 converts the aforementioned printing image for one page into video signals, and transmits the video signals to the printer engine 105. Upon transmitting the video signals to the printer engine 105, printing is made on an actual sheet, and the sheet is discharged. In Step S807, determination is made whether or not all the pages of the generated intermediate data have been printed. In the event that determination is made that all the pages have been printed, the flow returns to step S801. In the event that all the pages have not been printed, the flow returns to Step S805 where printing processing is performed for one page.

FIG. 9 is a flowchart describing the data analysis processing in Step S804 shown in FIG. 8. In Step S901, the analysis unit 403 reads out the printing data from the receiving buffer 402, and performs data analysis. The printing data is formed of multiple commands. In the data analysis processing, the analysis unit 403 analyzes each command. That is to say, the analysis unit 403 performs processing for each command, and repeats the analysis processing until all the printing data has been analyzed. The analysis unit 403 particularly analyzes to detect a discharging command (step S902). In the event that the analysis unit 403 detects the discharging command as a result of the analysis, the flow proceeds to step S903 where the intermediate data/code generated so far is recognized as the intermediate data/code for one page. Otherwise, the flow proceeds to Step S904. In Step S904, the analysis unit 403 performs processing for other commands. Specifically, the analysis unit 403 generates the intermediate data according to each command such as character command, image command, graphic command, or the like, and stores the generated intermediate data in the intermediate buffer 404. In Step S905, the analysis unit 403 determines whether or not there is any more data to be analyzed. In the event that determination is made that there is more data to be analyzed, the flow returns to Step S901. Otherwise, the analysis processing ends.

Figure 10:
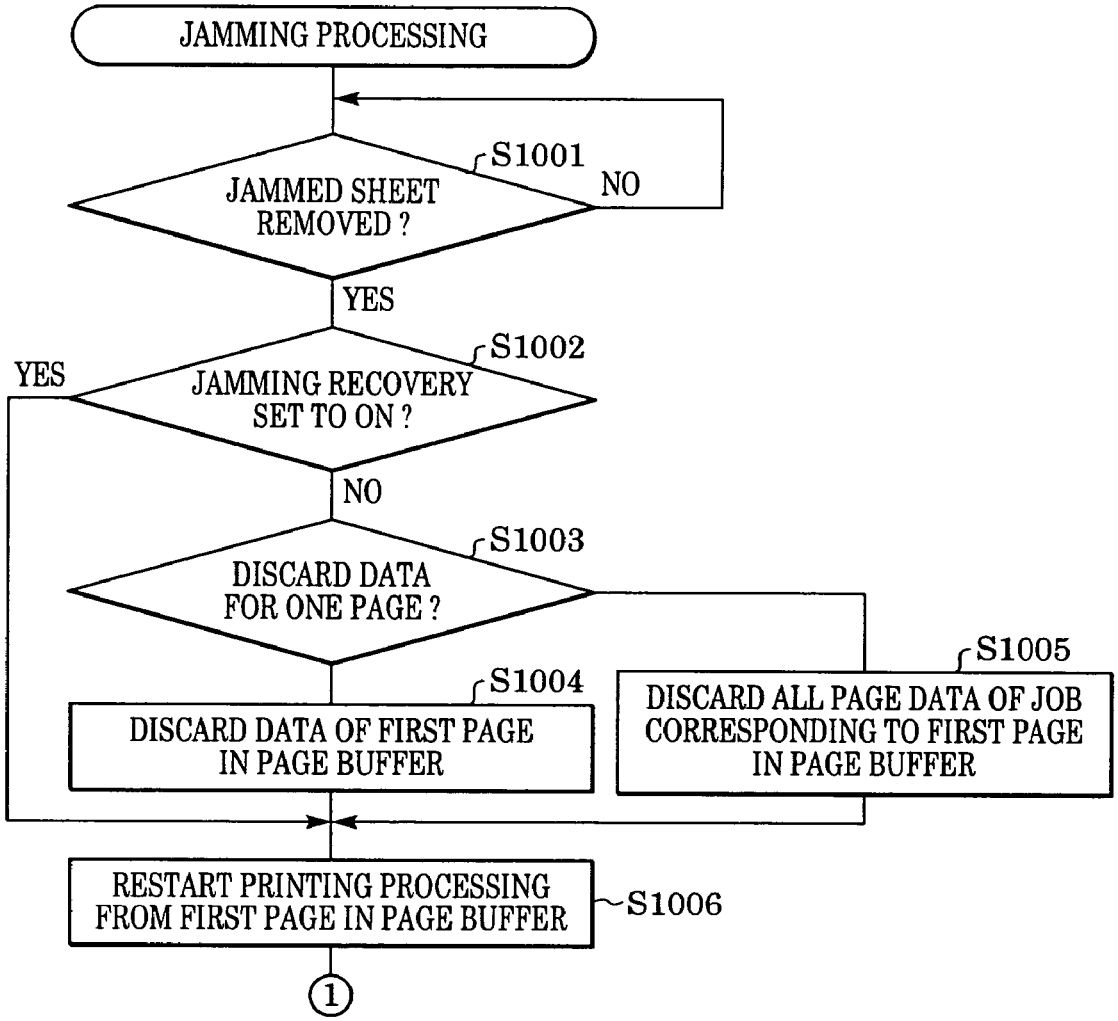
FIG. 10 is a flowchart which shows a processing flow performed by the printer in a case wherein jamming has occurred.

FIG. 10 is a flowchart which shows a processing flow performed by the printer 102 in the event that jamming has occurred. Note that description will be made regarding an operation example for executing the image formation job for consecutively printing image data of multiple page, wherein the sheet S fed with feeding roller 222 passes through the sheet-discharge sensor 270, following which the other sheet S is fed for the following page, whereby the image data of multiple pages is consecutively printed.

The printer 102 according to the present embodiment includes the sheet-discharge sensors 227S and 270, and the resist sensor 271 for detecting failure in transport of the sheet S within the printer 102. In the event that the printer engine control unit 1300 has detected failure in transport (jamming) of the sheet S based upon the signals regarding the presence or absence of the sheet output from the sheet-discharge sensors 227S and 270 and the resist sensor 271, the printer engine control unit 1300 transmits the status signal to the printer controller 103 for notifying the system that jamming has occurred. The aforementioned status signal which indicates that jamming has occurred includes information for specifying where the jamming has occurred within the printer 102. Upon the printer controller 103 receiving the status signal which indicates that jamming has occurred, from the printer engine control unit 1300, the printer controller 103 performs processing for handling the jamming.

Note that in the event that the resist sensor 271 has not detected the sheet S within a predetermined period of time from the point that the sheet has been transported with the feeding roller 222, the printer engine control unit 1300 transmits the status signal which indicates that sheet-feeding delay jamming has occurred. In the event that the resist sensor 271 has continuously detected the sheet S after a predetermined period of time from the point that the sheet S has been transported with the resist roller 223 (in the event that the sheet S has not passed through the resist sensor 271 after the predetermined period of time), the printer engine control unit 1300 transmits the status signal which indicates that sheet-feeding retention jamming has occurred. Furthermore, in the event that the sheet-discharge sensor 227S has not detected the sheet S within a predetermined period of time from the point that the sheet S has transported with the resist roller 223, the printer engine control unit 1300 transmits the status signals which indicate that the fixing delay jamming has occurred. Furthermore, in the event that the sheet-discharge sensor 227S has continuously detected the sheet S beyond a predetermined period of time (in the event that the sheet S has not passed through the sheet-discharge sensor 227S), the printer engine control unit 1300 transmits the status signal which indicates that fixing retention jamming has occurred. Furthermore, in the event that the sheet-discharge sensor 270 has not detected the sheet S within a predetermined period of time from the point that the sheet S has passed through the sheet-discharge sensor 227S (i.e., from the point that the state of the sheet-discharge sensor 227S has changed from the state which indicates the presence of the sheet to the state which indicates the absence of the sheet), the printer engine control unit 1300 transmits the status signal which indicates that sheet-discharge delay jamming has occurred. Furthermore, in the event that the sheet-discharge sensor 270 has continued to detect the same sheet S beyond a predetermined period of time (in the event that the sheet S has not passed through the sheet-discharge sensor 270), the printer engine control unit 1300 transmits the status signal which indicates that fixing retention jamming has occurred.

Note that in a case of the sheet-feeding delay jamming, the printer engine control unit 1300 transmits information regarding the transporting path from the feeding roller 222 up to the resist roller 223 for specifying the jamming, to the printer controller 103, as well as the aforementioned status signal. Furthermore, in a case of the sheet-feeding retention jamming, the printer engine control unit 1300 transmits information regarding the portion near the resist roller 223, to the printer controller 103, as well as the aforementioned status signal. Furthermore, in a case of the fixing delay jamming, the printer engine control unit 1300 transmits information regarding the transporting path from the resist roller 223 up to the fixing device 226, to the printer controller 103, as well as the aforementioned status signal. Furthermore, in a case of the fixing retention jamming, the printer engine control unit 1300 transmits information regarding the portion near the fixing device 226, to the printer controller 103, as well as the aforementioned status signal. Furthermore, in a case of the sheet-discharge delay jamming, the printer engine control unit 1300 transmits information regarding the transporting path from the transporting roller 227 up to the discharge roller 230, to the printer controller 103, as well as the aforementioned status signal.

First, in Step S1001, the system waits for the operator to remove the jammed sheet in execution of printing processing for the page data performed by the printer engine 105 according to the image formation job. The printer engine control unit 1300 determines whether or not the jammed sheet has been removed based upon the signals output from the sheet-discharge sensors 227S and 270 and the resist sensor 271, following detection of the signal which indicates that an openable door member of the printer 102 has been closed. In the event that the printer engine control unit 1300 determines that the jammed sheet has been removed, the printer engine control unit 1300 transmits the status signal which indicates that the jammed sheet has been removed, to the printer controller 103. Then, the flow proceeds to Step S1002 where the printer controller 103 (analysis unit 403) checks the job properties of the job (first job) corresponding to the current front page (the current printed page of the multiple pages which are to be printed according to the image formation job) (by referring the job management table) so as to confirm whether the jamming recovery function has been set to "ON" or "OFF". Note that in a case wherein the jamming recovery function has been set to "ON", the image data of the page corresponding to the sheet jammed due to failure in transport in execution of printing processing is output again from the output unit 407 to the printer engine 105. On the other hand, in a case wherein the jamming recovery function has been set to "OFF", the image data of the page corresponding to the sheet jammed due to failure in transport in execution of printing processing is not output again from the output unit 407 to the printer engine 105.

In the flowchart shown in FIG. 10, in the event that the analysis unit 403 of the printer controller 103 determines that the jamming recovery function has been set to "ON" in the job corresponding to the jammed sheet due to failure in transport, the flow proceeds to Step S1006. On the other hand, in the event that the analysis unit 403 of the printer controller 103 determines that the jamming recovery function has been set to "OFF" in the job corresponding to the jammed sheet due to failure in transport, the flow proceeds to Step S1003. In the data flow wherein the flow proceeds from Step S1002 to Step S1006, the system performs first control mode processing wherein the image data of the page corresponding to the jammed sheet due to failure in transport is output again from the output unit 407 to the printer engine 105 according to instructions from the corresponding image formation job. On the other hand, in the data flow wherein the flow proceeds from Step S1002 to Step S1003, the system performs second control mode processing wherein the image data of the page corresponding to the jammed sheet due to failure in transport is not output again from the output unit 407 to the printer engine 105 according to instructions from the corresponding image formation job.

Note that the setting of the jamming recovery function to "OFF" which has been made through the information processing device 101 using the input portion 708 on the user interface 707 shown in FIG. 7 has priority over the setting of jamming recovery function to "ON" which has been made through the operation panel, for the job corresponding to the jammed sheet due to failure in transport. On the other hand, the setting of the jamming recovery function to "ON" which has been made through the information processing device 101 using the input portion 708 on the user interface 707 shown in FIG. 7 has priority over the setting of jamming recovery function to "OFF" which has been made through the operation panel, for the job corresponding to the jammed sheet due to failure in transport.

In Step S1003, determination is made whether the system should discard the data of the one page (the one page corresponding to the jammed sheet due to failure of transport), or discard all the data corresponding to the one job. With the present embodiment, the setting is made by the user operating the operation panel of the printer 102 beforehand, and the setting value is stored in nonvolatile memory (e.g., EEPROM 310). Note that an arrangement may be made wherein the setting value is stored in the job properties through a printer driver program executed by the information processing device 101, and the setting value is stored in nonvolatile memory (e.g., EEPROM 310) in the printer controller 103 in a case where the input unit 401 receives the job from the information processing device 101. In the event that the setting has been made wherein the system discards the data of the one page corresponding to the jammed sheet, the flow proceeds to Step S1004 where the analysis unit 403 discards the data of the front page (image data of the page corresponding to the jammed sheet due to failure in transport) stored in the intermediate buffer 404. In this case, the CPU 309 sets the output unit 407 to output image data of a page, subsequent to the page corresponding to the transport-failure at the second control mode. On the other hand, in the event that the setting has been made wherein the system discards the data of all the pages of the one job corresponding to the jammed sheet, the flow proceeds to Step S1005 where the analysis unit 403 discards the data of all the pages which are to be printed according to instructions from the job which corresponds to the front page stored in the intermediate buffer 404. In this case, the CPU 309 sets the output unit 407 to not output image data of a page, subsequent to the page corresponding to the transport failure, and the CPU 309 also sets the output unit 407 to output an image of an image formation job, subsequent to the image formation job corresponding to the transport failure, at the second control mode. In Step S1006, printing processing is restarted from the front page remaining in the intermediate buffer 404, following which the flow returns to Step S905 shown in FIG. 8.

Figure 11:
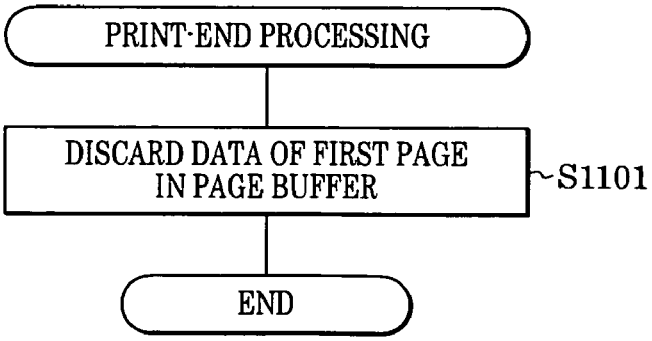
FIG. 11 is a flowchart which shows print-end processing performed by the printer.

FIG. 11 is a flowchart which shows print-end processing for the printer 102 according to the present embodiment.

In Step S1101, the print-end processing is performed. Upon correct completion of printing, the printer engine 105 transmits the signal which indicates that correct printing has been performed for one page. Upon the printer controller 103 receiving the aforementioned signal, the analysis unit 403 discards the intermediate data of the front page (page which has been printed) stored in the intermediate buffer 404.

The present embodiment described above allows the user to switch the jamming recovery mode. That is to say, when important documents, such as an account or the like, are to be printed, the present embodiment prevents double printing of such important documents due to jamming recovery. On the other hand, when normal documents are to be printed, the present embodiment maintains correct printing results by the action of jamming recovery.

Other Embodiments

Figure 16:
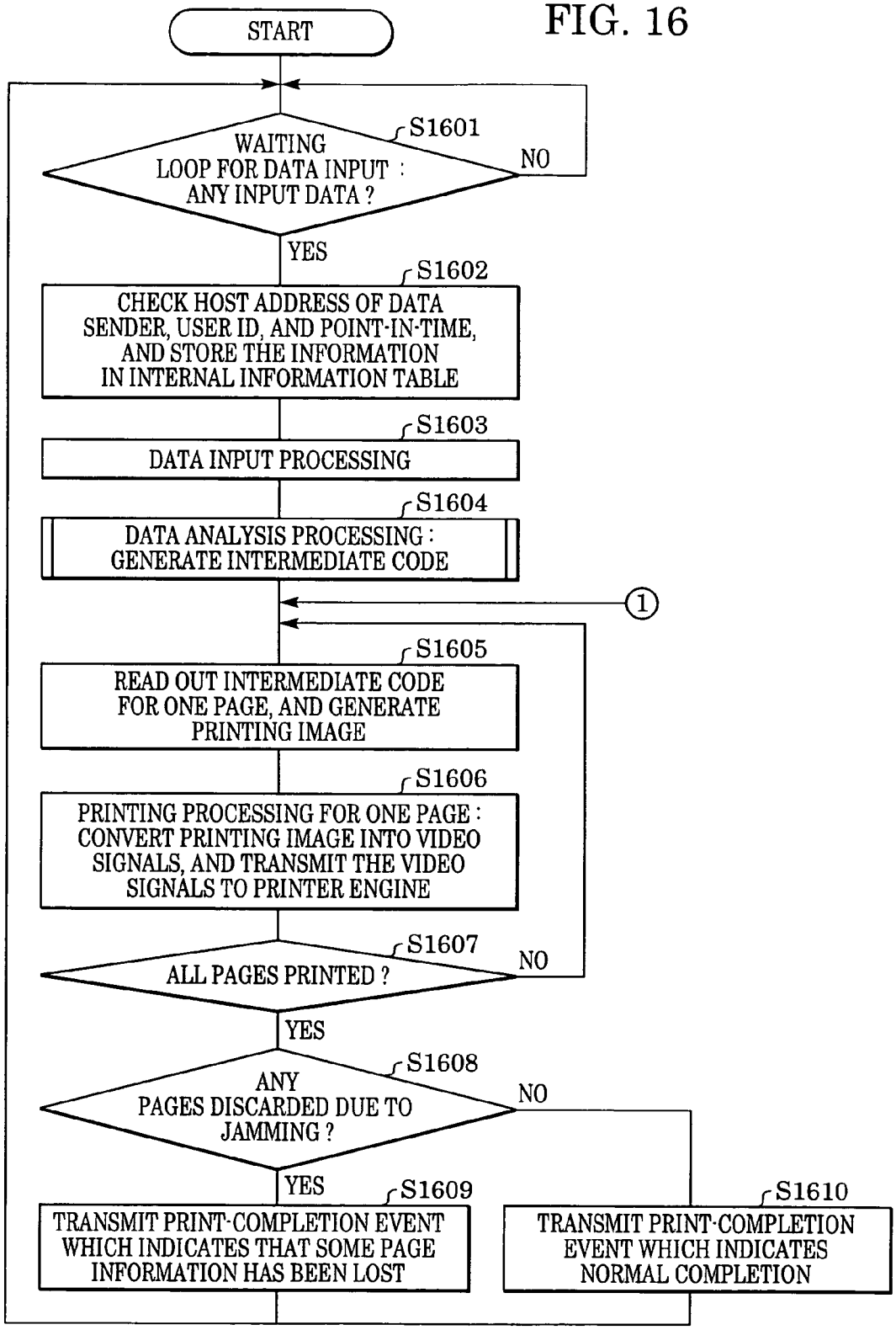
FIG. 16 is a flowchart which shows main processing.
Figure 17:
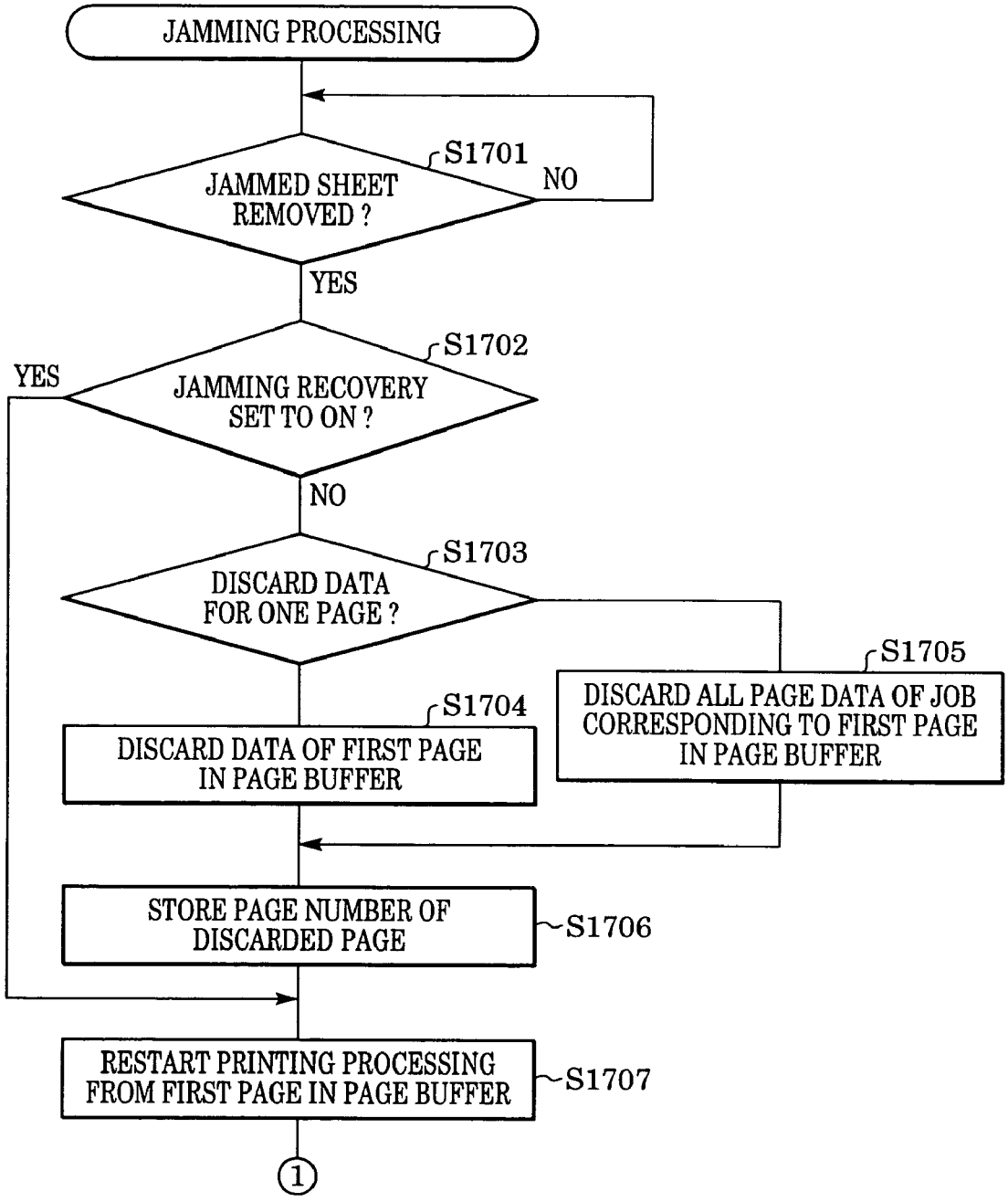
FIG. 17 is a flowchart which shows a processing flow performed by the printer in the event that jamming has occurred.

FIGS. 16 and 17 are flowcharts which show the processing of the printer controller 103 according to another embodiment of the present embodiment. FIG. 16 is a flowchart which shows main processing. Upon turning on the power supply, the system performs various kinds of unshown initial processing, following which the flow proceeds to Step S1601 serving as an input standby loop. Upon the information processing device 101 inputting printing data to the printer 102 through the network, the flow exits from the input standby loop, and proceeds to Step S1602. In step S1602, the system extracts the network address or the hardware address of the information processing device 101 serving as a data sender, the point in time, and the user ID, from the printing data transported from the information processing device 101 and the information stored in the network protocol packet, and stores the information thus extracted.

In Step S1603, the system performs input processing for the printing data. The input data is stored in the receiving buffer 402. In Step S1604, the analysis unit 403 analyzes the data stored in the receiving buffer 402. Following analysis of data, the analysis unit 403 generates the intermediate data having a format which facilitates data handling in the system according to the commands. The intermediate data is managed for each page, and is stored in the intermediate buffer 404. Note that FIG. 9 shows detailed configuration of the processing in Step S1604.

In step S1605, the rendering processing unit 405 reads out the intermediate data for one page from the intermediate buffer 404, and generates a printing image (bit map) based upon the intermediate data. The printing image thus generated is temporarily stored in the image buffer 406. In Step S1606, the output unit 407 converts the aforementioned printing image for one page into video signals, and transmits the video signals to the printer engine 105. Upon transmitting the video signals to the printer engine 105, printing is made on an actual sheet, and the sheet is discharged. In Step S1607, determination is made whether or not all the pages of the generated intermediate data have been printed. In the event that determination is made that all the pages have been printed, the flow proceeds to step S1608. In the event that not all of the pages have been printed, the flow returns to Step S1605 where printing processing is performed for one page. In Step S1608, determination is made whether or not any page corresponding to the job has been lost due to jamming.

With the present arrangement, the information regarding the lost page due to jamming is stored in storage means in Step S1706 described below. In the event that there is any page which has been lost, the system transmits a print-completion event which indicates that the page has been lost, to the information processing device in Step S1609. Note that the aforementioned print-completion event includes the information regarding the page number of the lost page. In a case of no lost page, the system transmits a print-completion event to the information processing device 101 in Step S1610, which indicates correct completion. Following the processing in Step S1609 or Step S1610, the flow returns to Step 1601. Also note that the aforementioned event notification is made according to an event-notification request command or the like, using the network address of the information processing device 101 which has been registered beforehand.

FIG. 17 is a flowchart which shows a processing flow performed by the printer 102 in the event that jamming has occurred. Note that description will be made regarding an operation example for executing the image formation job for consecutively printing image data of multiple page, wherein the sheet S fed with feeding roller 222 passes through the sheet-discharge sensor 270, following which the other sheet S is fed for the following page, whereby the image data of multiple pages is consecutively printed.

The printer 102 according to the present embodiment comprises the sheet-discharge sensors 227S and 270, and the resist sensor 271 for detecting failure in transport of the sheet S within the printer 102. In the event that the printer engine control unit 1300 has detected failure in transport (jamming) of the sheet S based upon the signals regarding the presence or absence of the sheet output from the sheet-discharge sensors 227S and 270 and the resist sensor 271, the printer engine control unit 1300 transmits the status signal to the printer controller 103 for notifying the system that jamming has occurred. The aforementioned status signal which indicates that jamming has occurred includes information for specifying where the jamming has occurred within the printer 102. Upon the printer controller 103 receiving the status signal which indicates that jamming has occurred, from the printer engine control unit 1300, the printer controller 103 performs processing for handling the jamming.

Note that in the event that the resist sensor 271 has not detected the sheet S within a predetermined period of time from the point that the sheet has been transported with the feeding roller 222, the printer engine control unit 1300 transmits the status signal which indicates that sheet-feeding delay jamming has occurred. In the event that the resist sensor 271 has continuously detected the sheet S after a predetermined period of time from the point that the sheet S has been transported with the resist roller 223 (in the event that the sheet S has not passed through the resist sensor 271 after the predetermined period of time), the printer engine control unit 1300 transmits the status signal which indicates that sheet-feeding retention jamming has occurred. Furthermore, in the event that the sheet-discharge sensor 227S has not detected the sheet S within a predetermined period of time from the point that the sheet S has transported with the resist roller 223, the printer engine control unit 1300 transmits the status signals which indicate that the fixing delay jamming has occurred. Furthermore, in the event that the sheet-discharge sensor 227S has continuously detected the sheet S beyond a predetermined period of time (in the event that the sheet S has not passed through the sheet-discharge sensor 227S), the printer engine control unit 1300 transmits the status signal which indicates that fixing retention jamming has occurred. Furthermore, in the event that the sheet-discharge sensor 270 has not detected the sheet S within a predetermined period of time from the point that the sheet S has passed through the sheet-discharge sensor 227S (i.e., from the point that the state of the sheet-discharge sensor 227S has changed from the state which indicates the presence of the sheet to the state which indicates absence of the sheet), the printer engine control unit 1300 transmits the status signal which indicates that sheet-discharge delay jamming has occurred. Furthermore, in the event that the sheet-discharge sensor 270 has continuously detected the sheet S beyond a predetermined period of time (in the event that the sheet S has not passed through the sheet-discharge sensor 270), the printer engine control unit 1300 transmits the status signal which indicates that fixing retention jamming has occurred.

Note that in a case of the sheet-feeding delay jamming, the printer engine control unit 1300 transmits information regarding the transporting path from the feeding roller 222 up to the resist roller 223 for specifying the jamming, to the printer controller 103, as well as the aforementioned status signal. Furthermore, in a case of the sheet-feeding retention jamming, the printer engine control unit 1300 transmits information regarding the portion near the resist roller 223, to the printer controller 103, as well as the aforementioned status signal. Furthermore, in a case of the fixing delay jamming, the printer engine control unit 1300 transmits information regarding the transporting path from the resist roller 223 up to the fixing device 226, to the printer controller 103, as well as the aforementioned status signal. Furthermore, in a case of the fixing retention jamming, the printer engine control unit 1300 transmits information regarding the portion near the fixing device 226, to the printer controller 103, as well as the aforementioned status signal. Furthermore, in a case of the sheet-discharge delay jamming, the printer engine control unit 1300 transmits information regarding the transporting path from the transporting roller 227 up to the discharge roller 230, to the printer controller 103, as well as the aforementioned status signal.

First, in Step S1701, the system waits for the operator to remove the jammed sheet in execution of printing processing for the page data performed by the printer engine 105 according to the image formation job. The printer engine control unit 1300 determines whether or not the jammed sheet has been removed based upon the signals output from the sheet-discharge sensors 227S and 270 and the resist sensor 271, following detection of the signal which indicates that an openable door member of the printer 102 has been closed. In the event that the printer engine control unit 1300 determines that the jammed sheet has been removed, the printer engine control unit 1300 transmits the status signal which indicates that the jammed sheet has been removed, to the printer controller 103. Then, the flow proceeds to Step S1702 where the printer controller 103 (analysis unit 403) checks the job properties of the job (first job) corresponding to the current front page (the current printed page of multiple pages which are to be printed according to the image formation job) (by referring the job management table) so as to confirm whether the jamming recovery function has been set to "ON" or "OFF". Note that in a case wherein the jamming recovery function has been set to "ON", the image data of the page corresponding to the sheet jammed due to failure in transport in execution of printing processing is output again from the output unit 407 to the printer engine 105. On the other hand, in a case wherein the jamming recovery function has been set to "OFF", the image data of the page corresponding to the sheet jammed due to failure in transport in execution of printing processing is not output again from the output unit 407 to the printer engine 105.

In the flowchart shown in FIG. 17, in the event that the analysis unit 403 of the printer controller 103 determines that the jamming recovery function has been set to "ON" in the job corresponding to the jammed sheet due to failure in transport, the flow proceeds to Step S1707. On the other hand, in the event that the analysis unit 403 of the printer controller 103 determines that the jamming recovery function has been set to "OFF" in the job corresponding to the jammed sheet due to failure in transport, the flow proceeds to Step S1703. In the data flow wherein the flow proceeds from Step S1702 to Step S1707, the system performs first control mode processing wherein the image data of the page corresponding to the jammed sheet due to failure in transport is output again from the output unit 407 to the printer engine 105 according to instructions from the corresponding image formation job. On the other hand, in the data flow wherein the flow proceeds from Step S1702 to Step S1703, the system performs second control mode processing wherein the image data of the page corresponding to the jammed sheet due to failure in transport is not output again from the output unit 407 to the printer engine 105 according to instructions from the corresponding image formation job.

Note that the setting of the jamming recovery function to "OFF" which has been made through the information processing device 101 using the input portion 708 on the user interface 707 shown in FIG. 7 has priority over the setting of jamming recovery function to "ON" which has been made through the operation panel, for the job corresponding to the jammed sheet due to failure in transport. On the other hand, the setting of the jamming recovery function to "ON" which has been made through the information processing device 101 using the input portion 708 on the user interface 707 shown in FIG. 7 has priority over the setting of jamming recovery function to "OFF" which has been made through the operation panel, for the job corresponding to the jammed sheet due to failure in transport.

In Step S1703, determination is made whether the system should discard the data of the one page (the one page corresponding to the jammed sheet due to failure of transport), or discard all the data corresponding to the one job. With the present embodiment, the setting is made by the user operating the operation panel of the printer 102 beforehand, and the setting value is stored in nonvolatile memory. Note that an arrangement may be made wherein the setting value is stored in the job properties through a printer driver program executed by the information processing device 101. In the event that the setting has been made wherein the system discards the data of the one page corresponding to the jammed sheet, the flow proceeds to Step S1704 where the analysis unit 403 discards the data of the front page (image data of the page corresponding to the jammed sheet due to failure in transport) stored in the intermediate buffer 404. On the other hand, in the event that the setting has been made wherein the system discards the data of all the pages of the one job corresponding to the jammed sheet, the flow proceeds to Step S1705 where the analysis unit 403 discards the data of all the pages which are to be printed according to instructions from the job which corresponds to the front page stored in the intermediate buffer 404.

In Step S1706, the system stores the page numbers of the pages which have been discarded in Step S1704 or Step S1705, i.e., the page numbers of the pages which have not been printed. Note that the system transmits the information at the time of transmission of print-completion event notification.

In Step S1707, printing processing is restarted from the front page remaining in the intermediate buffer 404, following which the flow returns to Step S1605 shown in FIG. 16.

Now, while description has been made regarding an arrangement according to the aforementioned first embodiment wherein a laser beam printer is employed as the printer 102, an arrangement may be made wherein an ink-jet printer, a digital multifunction device using the same laser-beam method, or the like, is employed as the printer 102.

Furthermore, an arrangement may be made wherein the system detects the position where jamming has occurred, and in a case wherein the jamming has occurred before printing of an image on an actual sheet (e.g., in a case of sheet-feeding delay jamming), jamming recovery is performed even if the jamming recovery function is set to OFF, in addition to the functions of the printer 102 according to the first embodiment described above. The aforementioned arrangement is reasonable since in this case, double printing is not performed.

Note that while description has been made regarding an arrangement example for executing the image formation job for consecutively printing the image data of multiple pages, wherein the sheet S fed with the feeding roller 222 passes through the sheet-discharge sensor 270, following which the other sheet S is fed for the following page, whereby the image data of multiple pages is consecutively printed, the present invention may be applied to other applications. For example, the present invention may be applied to an arrangement wherein the sheet S fed with feeding roller 222 passes through the sheet-discharge sensor 270, and the other sheet S is fed for the following page before the former sheet S passes through the sheet-discharge sensor 270, whereby the image data of multiple pages is consecutively printed. In this case, "data for one page" in Step S1003 shown in FIG. 10 is replaced by "image data corresponding to the pages which are being printed", i.e., "image data stored in the intermediate buffer 404". For example, in a case of jamming due to failure in transport of sheets within the printer 102 for two pages, determination is made whether or not the system removes the image data of the two pages from the intermediate buffer 404.

Furthermore, an arrangement may be made wherein, in the event that the number of copies has been set to more than one, jamming recovery is performed even if the jamming recovery function is set to OFF, in addition to the functions of the printer 102 according to the first embodiment described above. The aforementioned arrangement is reasonable since in this case, multiple sheets on which the same image has been printed are output in a normal situation without jamming. That is to say, with the aforementioned arrangement, the setting of multiple number of copies has priority over the setting of jamming recovery to OFF. In other words, in this case, the system ignores the setting of jamming recovery to OFF.

Figure 14:
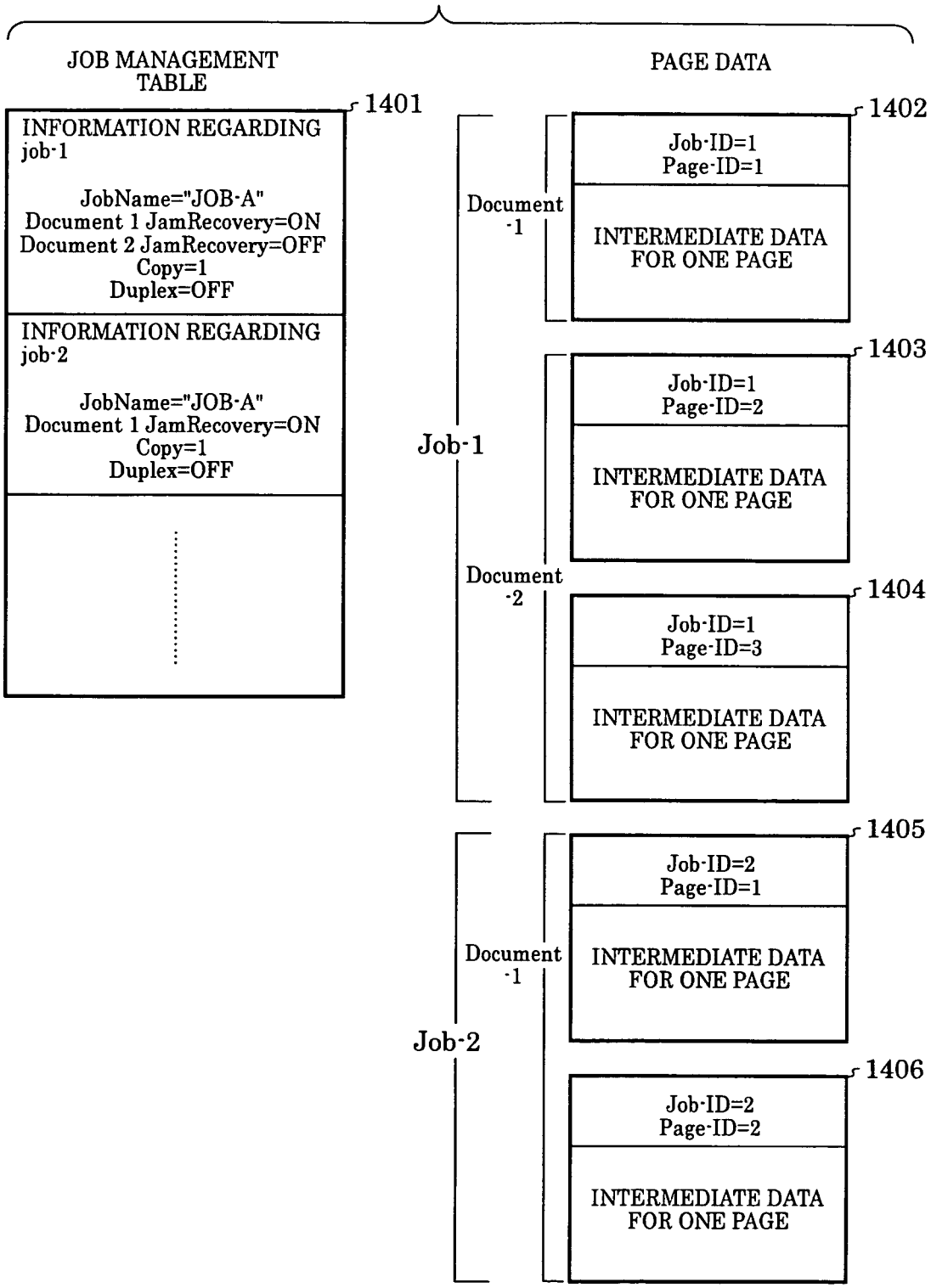
FIG. 14 is a diagram which shows a data structure of a job management table and a data structure of each page data.

Furthermore, an arrangement may be made wherein a conceptual data structure "document" is defined in the job, which is one hierarchical level below the job. With the aforementioned arrangement, a single document is formed of a series of document packets from the document-start packet up to the document-end packet. The document has document properties in the same way as with the job. Furthermore, an arrangement may be made wherein the jamming recovery function is set to ON or OFF in the document properties, instead of the job properties. FIG. 14 shows the data structure of the job management table and the data structure of each page according to the present arrangement. In FIG. 14, of the two jobs (Job-1, Job-2), Job-1 is formed of two documents (Document-1, Document-2), and the jamming recovery function is set to ON or OFF for each document.

Furthermore, the present invention may be applied to software for the printer 102 according to the first embodiment described above. For example, the present invention may be applied to a dedicated application such as a document printing application and so forth. In this case, an arrangement may be made wherein the application automatically determines whether the jamming recovery function is set to ON or OFF, i.e., the application controls execution of jamming recovery. With the present arrangement, the application classifies the kind of the document which is to be printed, and automatically determines whether the jamming recovery function is set to ON or OFF based upon the classification results, thereby allowing switching of the jamming recovery function without any user operation.

Figure 15:
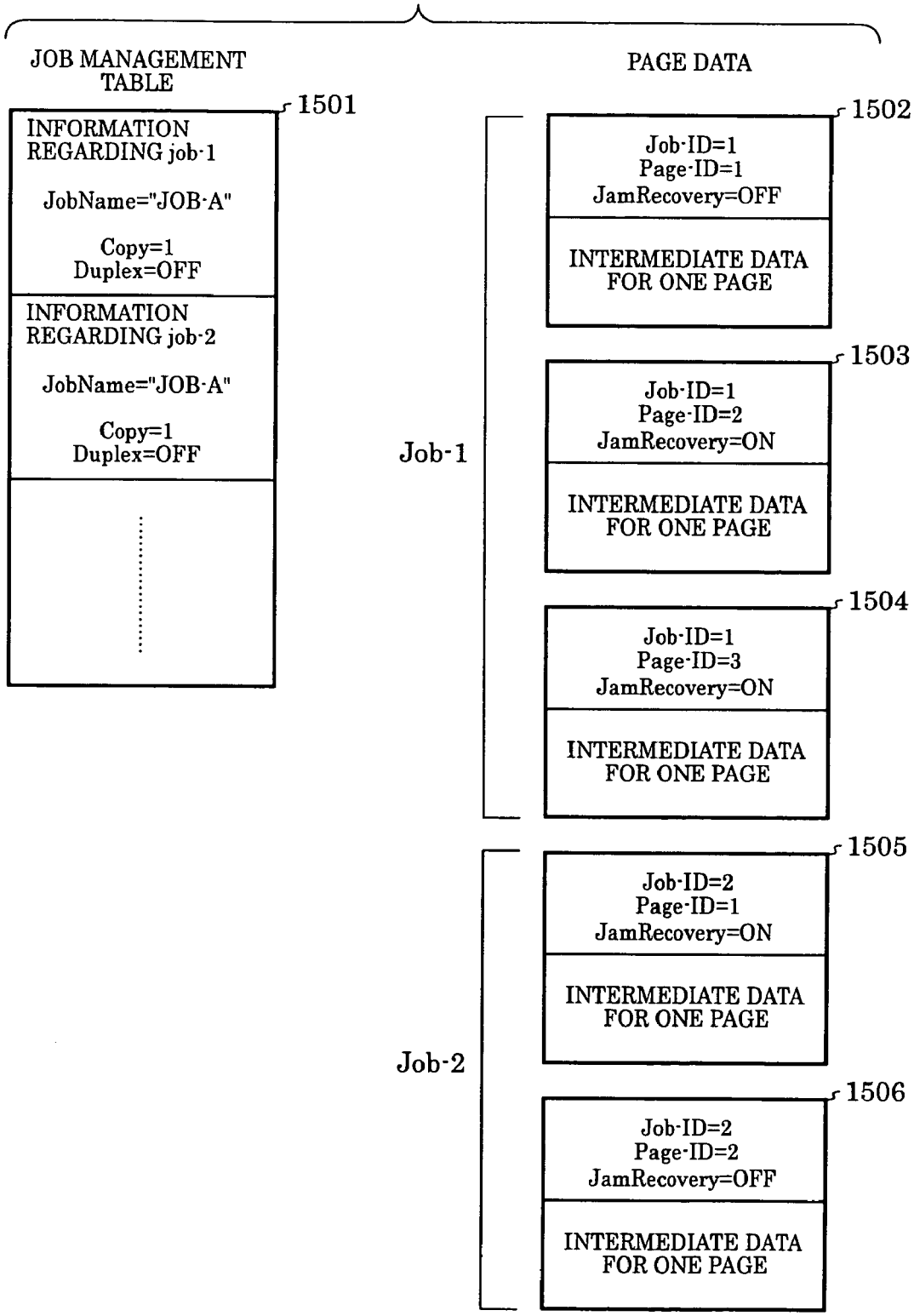
FIG. 15 is a diagram which shows a data structure of a job management table and a data structure of each page data.

Furthermore, an arrangement may be made wherein the jamming recovery function is set to ON or OFF for each page, instead of for each job or each document. FIG. 15 shows a data structure of the job management table and a data structure of each page according to the present arrangement. In FIG. 15, jamming recovery function is set to ON or OFF (JamRecovery is set to ON or OFF) for each page (Page-ID=1 to 3 of Job-1, Page-ID=1 to 2 of Job-2) of two jobs (Job-1, Job-2).

Furthermore, an arrangement may be made wherein in a case of setting of the jamming recovery function to OFF, the system records the fact that the data has been discarded due to jamming, in log information, and outputs the log information. This allows the user or the administrator to recognize the fact that the data has been discarded due to jamming without jamming recovery operation.

Furthermore, while description has been made regarding an arrangement wherein with the printer 102 according to the first embodiment, the analysis unit 403 analyzes the packet data (including image data of the multiple pages) received by the receiving buffer 402 so as to generate the job (image formation job) including the image data of multiple pages, the present invention is not restricted to the aforementioned arrangement, rather, an arrangement may be made wherein the printer 102 generates the image formation job by other methods. For example, an arrangement may be made wherein the printer 102 includes an image acquisition unit for reading a document as image data, and the image formation job is generated based upon the image data of multiple pages acquired with the image acquisition unit.

Furthermore, an arrangement may be made wherein a recording medium which stores program code of the software for executing the functions according to the embodiments described above is supplied to the system or the device, and the computer (CPU or MPU) thereof reads out and executes the program code. It is needless to say that such an arrangement achieves the object of the present invention.

In the aforementioned arrangement, the program code read out from the recording medium realizes the functions according to the embodiments described above. In this case, the present invention comprises the program code and the recording medium storing the program code.

Examples of recording media for supplying the program code include flexible disks, hard disks, optical disks, magneto-optical disks, CD-ROMs, CD-Rs, magnetic tape, non-volatile memory cards, ROM, and so forth.

Furthermore, it is needless to say that the present invention is not restricted to the aforementioned arrangement wherein the computer executes the program code thus read out so as to realize the functions according to the embodiments described above, rather, an arrangement may be made wherein the OS (basic system or operating system) operating on the computer executes a part of or all the actual processing according to instructions from the program code so as to realize the functions according to the embodiments described above.

Furthermore, it is needless to say that an arrangement may be made wherein the program code read out from the recording medium is written to memory included in a function extension board inserted to the computer or a function extension unit connected to the computer, following which a CPU included in the function extension board or the function extension unit executes a part of or all the actual processing according to instructions from the program code, thereby realizing the functions according to the embodiments described above.

Furthermore, an arrangement may be made wherein upon completion of printing for the job, the system transmits the data (event notification) to the information processing device 101, which indicates that printing has been completed for the job. Furthermore, an arrangement may be made wherein upon the information processing device 101 receiving the aforementioned event notification, the information processing device 101 displays a message or the like, thereby notifying the operator that printing has been completed for the job. Furthermore, an arrangement may be made wherein the system transmits the event notification data including information whether or not jamming has occurred and the information regarding the page lost due to jamming, and the information processing device 101 displays such information.

While the present invention has been described with reference to what are presently considered to be the embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

This application claims priority from Japanese Patent Application No. 2003-388377 filed Nov. 18, 2003, which is hereby incorporated by reference herein.

What is claimed is:

1. An image formation device operable to form images on sheets, the image formation device comprising:

a generating unit configured to generate an image formation job in order to form image data of a plurality of pages;

an image formation unit configured to form an image on a sheet based upon said image data;

a transport unit configured to transport the sheet;

an output unit configured to output image data generated by the generating unit to the image formation unit;

a detecting unit configured to detect transport failure of the sheet by the transport unit;

a first determining unit configured to determine whether the output unit re-outputs the image data corresponding to a jammed sheet due to transport failure to the image formation unit based upon the image formation job generated by the generating unit;

a second determining unit configured to determine whether the output unit outputs image data of the image formation job subsequent to the image data corresponding to the jammed sheet to the image formation unit in a case in which the first determining unit determines that the output unit does not re-output the image data corresponding to the jammed sheet to the image formation unit; and a control unit configured to control the output unit in accordance with the determination by the first determining unit and the second determining unit.

2. An image formation device according to claim 1, wherein the output unit outputs image data of an image formation job that is subsequent to the image formation job corresponding to the transport failure, in the case in which the first determining unit determines that the output unit does not re-output the image data corresponding to the jammed sheet to the image formation unit.

3. An image formation device according to claim 1, wherein the generating unit generates the image data based upon information received from an external device.

4. An image formation device according to claim 1, wherein the generating unit generates the image formation job based upon the image data of the plurality of pages obtained by reading out document pages.

5. An image formation device according to claim 1, wherein responsive to the image formation job including information that the image formation job should be re-outputted from the output unit, the first determining unit determines that the image data should be re-outputted from the output unit based upon the image formation job.

6. An image formation device according to claim 1, wherein responsive to the image formation job including infonnation that a page should be re-outputted from the output unit, the first determining unit determines that the image data of the page should be re-outputted from the output unit based upon the image formation job.

7. An image formation device according to claim 1, wherein the image formation job includes a first document information having image data of a plurality of pages and a second document information having image data of a plurality of pages; and wherein responsive to the first document information including information that the first document should be re-outputted from the output unit, the first determining unit determines that the image data of the page corresponding to the first document information should be re-outputted from the output unit.

8. An image formation device according to claim 1, further comprising:

a holding unit configured to hold the image data to be outputted from the output unit; and a discharge detecting unit configured to detect whether or not the sheet has been discharged, wherein responsive to the discharge detecting unit detecting that the sheet has been discharged, the holding unit removes the image data.

9. An image formation method comprising:

a generating step of generating an image formation job including image data of a plurality of pages;

an output step of outputting the image data corresponding to the image formation job;

an image formation step of forming an image on a sheet based upon the image data outputted in the output step;

a detecting step of detecting whether or not a transport failure of the sheet on which the image of a page is to be printed has occurred;

a first determining step of determining whether or not the image data of the page corresponding to a jammed sheet due to transport failure should be re-outputted in the output step based upon the image formation job generated in the generating step;

a second determining step of determining whether or not the image data of the image formation job subsequent to the image data corresponding to the jammed sheet should be outputted in the output step in a ease where the first determining step determines that the image data corresponding to the jammed sheet should be re-outputted in the output step; and a control step of controlling the output step in accordance with the determination in the first determining step and the second determining step.

10. An image formation method according to claim 9, wherein the output step includes outputting image data of an image formation job subsequent to the image formation job corresponding to the failed transport responsive to determining in the second determining step not to output the image data of the image formation job subsequent to the image data corresponding to the jammed sheet.

11. An image formation method according to claim 9, wherein the generating step includes generating the image formation job based upon information, received from an external device, regarding the image formation job.

12. An image formation method according to claim 9, wherein the generating step includes generating the image formation job based upon the image data of a plurality of pages obtained by reading out a document with a plurality of pages.

13. An image formation method according to claim 9, wherein the first determining step includes determining that the image data of the page should be re-outputted based on the information regarding the image formation job including information that the image formation job should be re-outputted.

14. An image formation method according to claim 9, wherein the first determining step includes determining that the image data of the page should be re-outputted based on the information regarding the image formation job including information that the page should be re-outputted.

15. An image formation method according to claim 9, wherein the image formation job includes a first document information having image data of a plurality of pages and a second document information having image data of a plurality of pages, and wherein the first determining step includes determining that the image data of the page corresponding to the first document information should be re-outputted responsive to the first document information including information that the first document should be re-outputted.

16. An image formation method according to claim 9, further comprising:

a discharge detecting step of detecting whether or not the sheet on which the image data of the page is to be printed according to the image formation job has been discharged; and a removing step of removing the image data of the page from a storage unit responsive to detecting the sheet on which the image data of the page is to be printed has been discharged in the discharge detecting step.

* * * * *